US005437968A

United States Patent [19]

Nagaoka

[11] Patent Number: 5,437,968

[45] Date of Patent: Aug. 1, 1995

[54] SILVER HALIDE COLOR PHOTOGRAPHIC LIGHT-SENSITIVE MATERIAL

[75] Inventor: Katsurou Nagaoka, Minami-Ashigara, Japan

[73] Assignee: Fuji Photo Film Co., Ltd., Kanagawa, Japan

[21] Appl. No.: 321,898

[22] Filed: Oct. 14, 1994

Related U.S. Application Data

[63] Continuation of Ser. No. 125,664, Sep. 23, 1993, abandoned.

[30] Foreign Application Priority Data

Oct. 20, 1992 [JP] Japan ..... 4-306241

[51] Int. Cl.[6] ..... G03C 1/46

[52] U.S. Cl. ..... 430/505; 430/506; 430/507; 430/510; 430/596; 430/957; 430/379; 430/503

[58] Field of Search ..... 430/505, 506, 507, 510, 430/596, 957, 379, 503

[56] References Cited

U.S. PATENT DOCUMENTS

| | | | |
|---|---|---|---|
| 2,673,800 | 3/1954 | Meeussen et al. | 430/214 |
| 2,937,086 | 5/1960 | Yutzy et al. | 430/507 |
| 3,345,169 | 10/1967 | McGuckin et al. | 430/232 |
| 3,993,488 | 11/1976 | Oishi | 430/510 |
| 4,129,446 | 12/1978 | Lohmann et al. | 430/507 |
| 4,626,498 | 12/1986 | Shuto et al. | 430/505 |
| 5,091,295 | 2/1992 | Kuwashima et al. | 430/507 |
| 5,298,369 | 3/1994 | Munshi | 430/379 |

FOREIGN PATENT DOCUMENTS

| | | |
|---|---|---|
| 0547983 | 12/1991 | European Pat. Off. . |
| 547983 | 6/1993 | European Pat. Off. . |
| 0304252 | 12/1988 | Japan . |
| 2110539 | 4/1990 | Japan . |
| 3226732 | 10/1991 | Japan . |

*Primary Examiner*—Thomas R. Neville
*Attorney, Agent, or Firm*—Sughrue, Mion, Zinn, Macpeak & Seas

[57] ABSTRACT

A silver halide color photograph light-sensitive material having an improved push-processing suitability. The material comprises a support having provided thereon at least one blue-sensitive emulsion layer, at least one green-sensitive emulsion layer, and at least one red-sensitive emulsion layer. The layers adjacent to each of layer having a color sensitivity contain yellow colloidal silver.

4 Claims, No Drawings

SILVER HALIDE COLOR PHOTOGRAPHIC LIGHT-SENSITIVE MATERIAL

This is a continuation of application Ser. No. 08/125,664 filed Sep. 23, 1993, now abandoned.

BACKGROUND OF THE INVENTION

1. Field of the Invention

The present invention relates to a silver halide color photographic light-sensitive material, and more specifically, to a light-sensitive material having an improved push-processing suitability.

2. Description of the Related Art

A silver halide color photographic light-sensitive material generally has at least one silver halide emulsion layer on a support, each layer having its own color sensitivity (the term "color sensitivity" used here is defined as the characteristic for sensing any of the three regions in the visible spectrum ray, namely, red, green, and blue).

In the field of color photographic light-sensitive materials, especially of color reversal light-sensitive materials which are often used by professional photographers, high-sensitivity color light-sensitive materials are required in order for photographs of special scenes including sports events, which requires a quick shutter speed, or theatricals in which the amount of light is very much limited, and usually too small for a usual exposure. However, there are few types of color light-sensitive photographs which meet the requirement of such an extremely high sensitivity.

In consideration of the above situation, adjustment of the sensitivity is carried out through a process to compensate the lack of the exposure light amount. The adjustment of the sensitivity through the process is called "push-processing". In the case of the color reversal light-sensitive material, the process is carried out by making the time period of the first development (black and white development) longer than the standard processing time.

However, the conventional color reversal light sensitive material does not always have a sufficient push-processing suitability, but may be of the followings.

1. The type which cannot be sensitized unless the time period for the first development is made much longer than the standard processing time.

2. In the case of a light-sensitive material having a structure divided into high-sensitivity layers and low-sensitivity layers, a change in gradation may occur by the push-processing, because both layers are different in development processing suitability.

3. The type which involves a significant decrease in color image density when the degree of sensitization is raised by prolonging the time period of the first development.

4. The type which involves the degradation of the color balance in the push-processing, due to the difference in development processing suitability between the red-, green-, and blue-sensitive layers.

There has been a great demand for development of a technique which can solve the above-listed drawbacks, freely control the degree of sensitization, and causes no bad influence on the standard process.

The object of the present invention is to provide such a technique, and a color photograph light-sensitive material prepared by the technique.

JP-A-51-128528 (U.S. Pat. No. 4,082,553) ("JP-A" means Published Unexamined Japanese Patent Application) discloses a color reversal light-sensitive material having an improved interlayer effect, which comprise a silver halide emulsion layer in which silver halide grains, the surface of each of which is fogged, are scattered. However, the surface-fogged silver halide grains are distinguished from those having fog in the interiors (JP-A-51-128528, claim 11), and the addition of surface-fogged silver halide grains causes a bad influence to the photographic property on the standard process, and significantly decreases the color image density in the push-processing.

U.S. Pat. Nos. 2,996,382; 3,178,282 and 3,397,987 discloses a negative image-forming photographic element having high speed and contrast increased by adding both silver halide grains which can form a surface latent image when exposed, and silver halide grains having an internally fogged core. However, the specification of these documents makes no mention of push-processing or a regular color reversal light-sensitive material. Further, in the photographic element, a silver halide grain having a surface latent image releases a reaction product in accordance with the exposure amount, which creates a cleavage in a silver halide grain having an internally fogged core, thereby enabling the development. Consequently, the speed and contrast are increased even in the standard development, and the sensitization by the push-processing cannot be controlled.

Further, JP-B-46-19024 (U.S. Pat. No. 3,505,068) ("JP-B" means Published Examined Japanese Patent Application) discloses a method of effectively lowering the contrast in a color reversal light-sensitive material having each emulsion layers of the same light-sensitivity divided into a high-sensitive layer which uses silver iodide, and a low-sensitive layer which uses grains each obtained by covering the core of silver haloiodide with a silver-iodide-free silver halide shell. However, the core/shell type silver halide grain used here does not have an internally fogged core, show any special effect with regard to the push-processing.

JP-A-59-214852 discloses a technique of suppressing the change in gradation or the deterioration of color balance, and decreasing the lowering rate of the color image density in the push-processing, in which the silver halide emulsion having an internally fogged core is added to the silver halide emulsion layer or adjacent layers thereof so as to make the fogged core to function during the push-processing, advancing the development. In this technique, the sensitivity of the emulsion layer to which the silver halide emulsion having the internally fogged core increases in the push-processing, and therefore the color balance after the push-processing can be adjusted by adding the emulsion to the emulsion layer having a relatively low degree of sensitization.

In the case where the increase in sensitivity after the push-processing of a particular emulsion layer is extremely great, the rise of the sensitivity, in some cases, is insufficient even if the silver halide emulsion having the internally fogged core is added in great amount to the emulsion layer having a low degree of sensitization. In this case, a good color balance cannot be achieved after the push-processing, and further the color image density decreases due to the emulsion having the internally fogged core added in great amount.

Colloidal silver is known as an agent for enhancing the development activity of adjacent layers more than the above fogged emulsion. For example, JP-A-60-126652, JP-A-63-304252, JP-A-2-110539, JP-A-3-113438, JP-A-3-226732, and U.S. Pat. No. 979,001 discloses a light-sensitive material containing colloidal silver in its emulsion layer or adjacent layers thereof. Of these documents, U.S. Pat. No. 979,001, JP-A-60-126652, JP-A-63-304252, JP-A-2-110539, and JP-A-3-113438 are directed to improvement of the reproducibility of the image quality or gradation. Although JP-A-3-226732 covers the push-processing suitability also, this document makes no mention of yellow colloidal silver giving a high push-processing suitability, or addition of yellow colloidal silver to adjacent layers of each of layer having a color sensitivity.

As described above, there have never been studies of the influence of colloidal silver on improvement of the development activity, more specifically, there have never been researches on what type of colloidal silver, and how it should be added to a light-sensitive material for achieving a preferable push-processing suitability.

SUMMARY OF THE INVENTION

It is an object of the present invention to provide a silver halide color photographic light-sensitive material having an improved push-processing suitability.

The inventor of the present invention conducted intensive studies, and found that the above object of the present invention can be achieved by the means described in items (1)–(6) below.

(1) A silver halide color photograph light-sensitive material comprising a support having provided thereon at least one blue-sensitive emulsion layer, at least one green-sensitive emulsion layer, and at least one red-sensitive emulsion layer, wherein layers adjacent to each of layer having a color sensitivity contain yellow colloidal silver.

(2) The silver halide color photograph light-sensitive material described in item (1) above, wherein the yellow-colloidal-silver-containing layer is located adjacent to the lowest-sensitivity layer of each of layer having a color sensitivity.

(3) The silver halide color photograph light-sensitive material described in item (1) above, wherein each of blue-sensitive emulsion layer, each of green-sensitive emulsion layer, and each of red-sensitive emulsion layer consists of at least 3 layers having difference sensitivities from each other.

(4) The silver halide color photograph light-sensitive material described in item (1) above, wherein the total amount of silver coated is 2 g/m$^2$ or more.

(5) The silver halide color photograph light-sensitive material described in item (1) above, containing surface-fogged and/or internal-fogged silver bromoiodide emulsion.

(6) The silver halide color photograph light-sensitive material described in item (1) above, containing a DIR compound represented by the following formula (I).

Formula (I)

$$A-(L)_n-(G)_m-(Time)_t-X$$

In the above formula, A represents a redox mother nucleus or a precursor thereof, and a group which enables $-(Time)_t-X$ to leave when the compound is oxidized during the processing of photograph development, and X represents a development inhibitor. L represents a divalent linking group, and G represents an acidic group. Time represents a group which can further release X thereafter, and may have a timing-adjusting function, or may be a coupler which releases X when reacted with an oxidized form of a developing agent, or may be a redox group. n, m, and t are 0 or 1; however, when n=1, m cannot be 0.

In the present invention, the colloidal silver should have a color in yellow, with a maximum absorption wavelength of 400 nm–500 nm, specifically, 430 nm –460 nm.

Preparations of various types of colloidal silver are set forth, for example, in "Colloidal Elements" written by Weiser (Yellow Colloidal Silver by Dextrin Reduction Method by Carey Lea), published in 1933, by Wiley & Sons of New York, German Patent 1,096,193 (brownish and black colloidal silver), and U.S. Pat. No. 2,688,601 (blue colloidal silver). Of the various types of colloidal silver, particularly, yellow colloidal silver having a maximum absorption wavelength of 400 nm –500 nm is found to exhibit an effect to give a push-processing suitability. For example, by way of adding potassium iodide into yellow colloid, the maximum absorption wavelength can be elongated. In this case, the improvement of the push-processing suitability, which is achieved by the addition of colloidal silver, is significantly decreased, or in some case, not admitted at all. The fact that the photographic property of the sensitization material is notably varied with the type or color of colloidal silver cannot be expected from the description in any of, for example, JP-A-60-126652, JP-A-63-304252, JP-A-2-110539, JP-A-3-113438, JP-A-3-226732, and U.S. Pat. No. 979,001.

In the present invention, it is important that the layers containing yellow colloidal silver are located adjacent to all of the blue-sensitive emulsion layer, green-sensitive emulsion layer, and red-sensitive emulsion layer. In the conventional light-sensitive materials, especially, of the types used for photography, a blue-sensitive layers, green-sensitive layers, and red-sensitive layers are arranged in that order, with the blue-sensitive layer furthest from the support. In many cases, yellow colloidal silver is provided between the blue-sensitive layers and green-sensitive layers such that the yellow colloidal silver functions as a filter, and black colloidal silver is provided between the red-sensitive layer and the support such that the black colloidal silver functions as an anti-halation. However, black colloidal silver and yellow colloidal silver differs greatly from each other in effect of raising its development activity, and therefore unless they are located adjacent to all layers having a color sensitivity in the same fashion, the color balance is deteriorated when a push-processing suitability is conducted.

In the present invention, it is necessary that yellow colloidal silver be added to layers adjacent to the blue-sensitive emulsion layers, green-sensitive emulsion layers, and red-sensitive emulsion layers. If the yellow colloidal silver is added to the emulsion layers, undesirably unnecessary fog is created during the storage of the light-sensitive material or the development processing. Or, if the yellow colloidal silver is added to layers which are not adjacent to a layer having a color sensitivity via an interlayer provided between the layers and the color-sensitive layer, the effect of development activity is not enhanced.

In the case where the blue-sensitive emulsion layers, green-sensitive emulsion layers, and red-sensitive emulsion layers consist of two or more layers having sensitivities or spectral sensitivities different from each other, the yellow-colloidal-silver-containing layer should preferably be adjacent to the lowest-sensitive layer of each layer having a color sensitivity. The layer with the highest-sensitivity tends to be developed first; however with a yellow colloidal silver provided adjacent to the lowest-sensitivity layer, the push-processing suitabilities of the highest-sensitive and the lowest-sensitive layers are balanced with each other, thereby reducing the change in gradation caused by a sensitization development processing.

The above-described effect is especially notable when the blue-sensitive emulsion layers, green-sensitive emulsion layers, and red-sensitive emulsion layer consist of 3 or more layers having different sensitivities. In the case where the total amount of silver coated in the light-sensitive layer is 2 $g/m^2$ or more, a remarkable effect can be achieved. If the total amount of silver coated is excessive, the effect of the yellow colloidal silver cannot be fully obtained, and the total amount is preferably 3 $g/m^2$ or more but 6 $g/m^2$ or less, more preferably 4 $g/m^2$ or more but 5 $g/m^2$ or less.

It was quite unexpectable that the effect of improving the development proceeding property by adding yellow colloidal silver in a layer adjacent to the light-sensitive layer, varies along with the composition of the layer having a color sensitivity of the light-sensitive material or the amount of silver applied. Such a phenomenon can be explained in the following way. The reason why the development of a relatively low-sensitive layer tends to be slow is due to halogen ions released by the development of a relatively high-sensitive layer. In other words, the larger the amount of applied silver halide, which serves to slow down the development of the low-sensitivity layer, or the more the number of high-sensitivity layers with respect to the number of low-sensitivity layers, the greater the effect of the development proceeding property of yellow colloidal silver contained in layers adjacent to the low-sensitive layers.

In the present invention, the preferable addition amount of yellow colloidal silver is 0.001 to 0.4 $g/m^2$per each layer, more preferably 0.003 to 0.3 $g/m^2$.

In the present invention, yellow colloidal silver is desirably used along with surface-fogged and/or internal-fogged silver halide grains so as to control the balance among the color-sensitive layers during the push-processing.

The grain-surface-fogged and/or internal-fogged silver halide grains used in the present invention will now be described.

In the present invention, the surface-fogged and/or internal-fogged silver halide grains can be defined as the silver halide grains prepared such that each grain has a fogged core on the surface and/or inside of the grains by a chemical or optical method, and can be developed regardless of exposure.

The silver halide grains having a fogged surface (surface-fogged type silver halide grains) can be prepared by fogging silver halide grains using a chemical or optical method during and/or after the grain formation of silver halide.

The above fogging step can be performed by the method of adding a reducing agent or a gold salt to the grains under appropriate pH and pAg, or the method of heating the grains under a low pAg, or the method of subjecting the grains to a uniform exposure. Examples of the reducing agent are stannous chloride, hydrazin compounds, ethanol amine, thiourea dioxide.

These fogging step with use of the fogging substances should be carried out before the water-washing step for the purpose of prevention of fog long with time elapse due to diffusion of the fogging substances into the light-sensitive emulsion layer.

The silver halide grains having a fogged inside (internal-fogged type silver halide grains) can be prepared by forming a shell on the surface of each surface-fogged type silver halide grain as a core. Such an internal-fogged type silver halide is described in detail in JP-A-59-214852. The effect of the internal-fogged type silver halide grains with regard to the sensitization development can be adjusted by changing the thickness of the shell.

Also, the silver halide grains each having a fogged inside can be prepared by fogging silver halide grains using the above-described fogging method from the start of the formation of grains, and covering the grains with unfogged shells after formation of fogged cores. If necessary, the grains can be fogged entirely from the inside to the surface.

These fogged silver halide grains may be any of silver chloride, silver bromochloride, silver bromoiodide, and silver bromochloroiodide, but preferably silver bromide, or silver bromoiodide. In this case, the iodide content is preferably 5 mole% or less, more preferably 2 mole% or less. Further, the fogged silver halide grains may have internal structures of different halogen compositions.

The average grain size of the fogged silver halide grains used in the present invention is not particularly limited. However, when these fogged silver halide grains are added to a light-sensitive silver halide emulsion layer or non-light-sensitive layer, the average grain size of the grains should be smaller than that of the silver halide grains in the adjacent lowest-sensitive layer. More specifically, the average grain size is preferably 0.5 μm or less, more preferably 0.2 μm or less, and most preferably 0.1 μm.

The shape of the fogged silver halide grains is not particularly limited, and may be regular or irregular. Also, the fogged silver halide grains may be polydisperse, but the monodisperse type is preferable.

The amount of use of the fogged silver halide silver grains can be arbitrary changed in accordance with the degree of necessity. However, when expressed in the ratio with respect to the total amount of light-sensitive silver halide contained in all the layers of the color light-sensitive material, the amount of use is preferably 0.05–50 mole%, more preferably 0.1–25 mole%. In view of the fogging efficiency per amount of silver used, surface-fogged type silver halide having a smaller average grain size (specifically 0.2 μm or less).

In order to control the distribution of the development proceeding of each layer, and the development proceeding speed of each layer, internal-fogged emulsion should be used. The thickness of the shell of the internal-fogged emulsion grains added to each layer should be adjusted so as to achieve a necessary development speed at a necessary timing.

In the present invention, a DIR compound represented by formula (I) can be preferably used.

The DIR compound represented by the following Formula (I) will be described below in detail. Formula (I)

4nr&AlrS41r&]nr(G4or(Ulr)]4or+@nrU

A $(L)_n$ $(G)_m$ $(Time)_t$ X

In the Formula (I), the redox mother nucleus represented by A in the formula (I) is one which accords to the Kendall-Pelz law. Examples of this nucleus are: hydroquinone, catechol, p-aminophenol, o-aminophenol, 1,2-naphthal-enediol, 1,4-naphthalenediol, 1,6-naphthalenediol, 1,2-aminonaphthol, 1,4-aminonaphthol, 1,6-aminonaphthol, gallate, gallic amide, hydrazine, hydroxylamine, pyrazolidone, or reductone.

It is desirable that the amino group which these redox mother nuclei have be substituted with a sulfonyl group having 1 to 25 carbon atoms or an acyl group having 1 to 25 carbon atoms. Examples of the sulfonyl group are substituted or unsubstituted aliphatic sulfonyl group and an aromatic sulfonyl group. The hydroxy or amino group which forms the redox mother nucleus represented by A may be protected by a protective group which enables to deprotect at the time of development. Examples of the protective group are those having 1 to 25 carbon atoms each, such as acyl group, alkoxycarbonyl group, carbamoyl group, and the protective groups disclosed in JP-A-59-197037 and JP-A-59-201057. The protective group may bond to the substituent group for A, if possible, will be described below, to form a 5-, 6-, or 7-membered ring.

The redox mother nucleus represented by A, in its substitutable position, may be substituted with a substituent group. Examples of this substituent group are those having 25 or less carbon atoms, such as alkyl group, aryl group, alkylthio group, arylthio group, alkoxy group, aryloxy group, amino group, amido group, sulfonamido group, alkoxycarbonylamino group, ureido group, carbamoyl group, alkoxycarbonyl group, sulfamoyl group, sulfonyl group, cyano group, a halogen atom, acyl group, carboxyl group, sulfo group, nitro group, heterocyclic residue, and a group represented by the formula (Ia) described below. These substituent groups may, in turn, be substituted with the substituent groups described above. These substituent groups may bond together, if possible, forming a saturated or unsaturated carbon ring or a saturated or unsaturated heterocyclic ring. Formula (Ia)

$$\text{-}(L)_n\text{-}(G)_m\text{-}(Time)_t\text{-}X$$

Preferable examples of A are: hydroquinone, catechol, p-aminophenol, o-aminophenol, 1,4-naphthalenediol, 1,4-aminonaphthol, gallate, gallic amide, and hydrazine. Of these, hydroquinone, catechol, p-aminophenol, o-aminophenol, and hydrazine are particularly preferable. Hydroquinone and hydrazine are more preferable than any other redox mother nucleus exemplified here.

L in the formula (Ia) is a divalent linking group. Preferable as this group are: alkylene, alkenylene, arylene, oxyalkylene, oxyarylene, aminoalkyleneoxy, aminoalkenyleneoxy, aminoaryleneoxy, and an oxygen atom.

G in the formula (Ia) is an acidic group. It is preferably —CO—, —COCO—, —CS—, —SO—, $SO_2$—, —PO($OR^{21}$)—, or —C(=$NR^{22}$)—. Here, $R^{21}$ is alkyl, aryl, or heterocyclic ring, and $R^{22}$ is a hydrogen atom or of the same meaning as $R^{21}$. Of the examples of G, —CO—, —COCO—, —PO($OR^{21}$)— and —C(—$NR^{22}$)— particularly preferable. Of these four examples, —CO— and —COCO— are preferable. The most preferable is —CO—.

In the formula (Ia), n and m are 0 or 1. Whether n and m should better be 0 or 1 depends on the type of A. Preferably, n=0, more preferably n=m=0 if A is hydroquinone, catechol, aminophenol, naphthalenediol, aminonaphthol, or an gallic acid. Preferably, n=0, m=1 if A is hydrazine or hydroxylamine. Preferably, n=m=1 if A is pyrazolidone. However, when n=1, m cannot be 0.

In the formula (I), -$(Time)_t$-X is a group which will be released, in the form of [-$(Time)_t$-X]$^-$, when the redox mother nucleus undergoes cross oxidation and changes into an oxidized form during the processing of development.

It is desirable that "Time" links to G through a sulfur atom, a nitrogen atom, an oxygen atom, or a selenium atom.

"Time" may be a group which enables to release X after it has been released, and may have timing-adjusting function. Alternatively, it may be a coupler or a redox group which react with the oxidized form of a developing agent, thereby to release X.

Examples of "Time" which has timing-adjusting function are disclosed in, for example, U.S. Pat. Nos. 4,248,962, 4,409,323, British Patent 2,096,783, U.S. Pat. No. 4,146,396, JP-A-51-146828, and JP-A-57-56837. Two or groups, selected from these, may be used in combination.

Preferred examples of the timing-adjusting group are as follows:

(1) Group utilizing cleavage reaction of hemiacetal:

The group represented by the following formula (T-1), and examples thereof are disclosed in U.S. Pat. No. 4,146,396, JP-A-60-249148, and JP-A-60-249149. In the formula, symbol * indicates the position which is bonded to the left-hand side of the formula (I), whereas symbol ** indicates the position which is bonded to the right-hand side of the formula (I).

Formula (T-1)

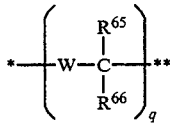

In the formula (T-I), W represents an oxygen atom, sulfur atom or —$NR^{67}$-group, each of $R^{65}$ and $R^{66}$ represents a hydrogen atom or a substituent group, $R^{67}$ represents a substituent group, and q is either 1 or 2.

When q is 2, two sets of —W—$CR^{65}(R^{66})$— may be the same or different.

Typical examples of each of $R^{65}$ and $R^{66}$, when each representing a substituent group, and $R^{67}$ are $R^{69}$ group, $R^{69}CO$-group, $R^{69}SO_2$-group, $R^{69}NCO(R^{70})$-group, and $R^{69}N(R^{70})SO_2$-group, where $R^{69}$ represents an aliphatic group, an aromatic group, or heterocyclic group, and $R^{70}$represents an aliphatic group, an aromatic group, a heterocyclic group, or a hydrogen atom. Further, $R^{65}$, $R^{66}$, and $R^{67}$ each represents a divalent group, and may be bonded with each other to form a cyclic structure.

(2) Group causing cleavage reaction using intramolecular nucleophilic displacement reaction:

An example of the group is the timing group disclosed in U.S. Pat. No. 4,248,962, and the group is represented by the following formula (T-2).

Formula (T-2)

*—Nu—Link—E—**

In the formula (T-2), symbol * indicates the position which is bonded to the left-hand side of the formula (I), whereas symbol  indicates the position which is bonded to the right-hand side of the formula (I). Nu represents a nucleophilic group such as an oxygen atom or s sulfur atom, E represents an electrophilic group, which can cleave the bonding at symbol  upon a nucleophilic attack by Nu, and Link represents a linking group which link Nu and E stereometrically together so that an intracellular nucleophilic displacement reaction can occur.

(3) Group causing cleavage reaction using electron transfer reaction in conjugated system:

Examples of the group are set forth in U.S. Pat. Nos. 4,409,323 and 4,421,845, and the group is represented by the formula (T-3).

Formula (T-3)

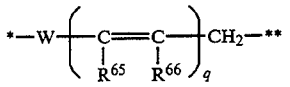

In the formula (T-3), each of symbols , and **, W, $R^{65}$, $R^{66}$, and q has the same meaning as in the formula (T-1).

(4) Group utilizing cleavage reaction by hydrolysis of ester:

An example of the group is the linking group disclosed in German Patent 2,626,315, and the group is represented by the following formula (T-4) or (T-5).

Formula (T-4)

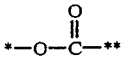

Formula (T-5)

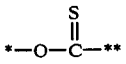

In the formulas (T-4) and (T-5), each of symbols and **, has the same meaning as in the formula (T-1).

(5) Group utilizing cleavage reaction of iminoketal:

An example of the group is the linking group disclosed in U.S. Pat. No. 4,546,073, and the group is represented by the following formula (T-6).

Formula (T-6)

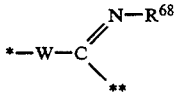

In the formulas (T-6), each of symbols * and **, and W has the same meaning as in the formula (T-1), and $R^{68}$ and $R^{67}$ have the same meaning.

The following can be cited as examples of the group represented by "Time" which is either a coupler or a redox group.

An example of "Time" which is a coupler is a phenol type coupler which is bonded to G in the formula (I) at the oxygen atom of the hydroxy group which is removed a hydrogen atom. Another example of "Time" which is a coupler is a 5-pyrazoline type coupler which is bonded to G at the oxygen atom of the tautomerized hydroxy group which is removed a hydrogen atom. These couplers act as couplers only after they have left G, reacting with an oxidized form of a developing agent and then releasing X bonded the coupling position.

Preferable examples of "Time" which is a coupler are those represented by the following formulas (C-1) to (C-4):

Formula (C-1)

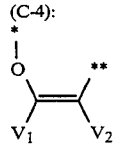

Formula (C-2)

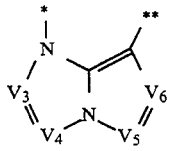

Formula (C-3)

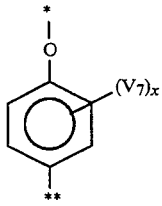

Formula (C-4)

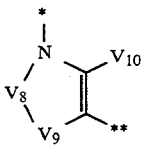

In these formulas, $V_1$ and $V_2$ are substituent groups, $V_3$, $V_4$, and $V_5$ are nitrogen atoms or substituted or unsubstituted methine groups, $V_7$ is a substituent group, x is an integer ranging from 0 to 4, $V_7$ represents identical or different groups if x is 2, 3 or 4, two groups $V_7$ may bond to each other to form a ring-like structure, V8 is —CO— group, —$SO_2$— group, an oxygen atom, or a substituted imino group, $V_9$ is a non-metal atom group which combine with —$V_8$—N—C=C— to form a 5- to 8-membered ring, and $V_{10}$ is a hydrogen atom or a substituent group.

The symbol * indicates the position where the group bonds to the left-hand side of the formula (I), whereas the symbol ** indicates the position where the group bonds to the right-hand side of the formula (I).

If the group represented by "Time" in the formula (I) is a redox group, it is preferably one which is represented by the following formula (R-1):

Formula (R-1)

*-P-(Y=Z)$_m$-Q-B

In the formula (R-1), P and Q are independently an oxygen atom or a substituted or unsubstituted imino group, at least one of m number of Y's and m number of Z's is a methine group having X in the formula (I) as a substituent group, and the remaining Y's and Z's are substituted or unsubstituted methine groups or nitrogen atoms, m is an integer ranging from 1 to 3 (m number of Y's are identical or different, and k number of Z's are likewise identical or different), and B is a group which can be removed by a hydrogen atom or alkali. The symbol * indicates the position where the group bonds to G of formulas (I).

Two of substituent groups P, Y, Z, Q and B may change to divalent groups, which link together to form a ring-like structure. For example, $-(Y=Z)_k-$ may form a benzene ring or a pyridine ring.

When each of P and Q represents a substituted or unsubstituted imino group, each of them is preferably an imino group substituted by a sulfonyl group or an acyl group, and P and Q are represented by the following formulas (N-1) and (N-2), respectively.

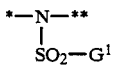

Formula (N-1)

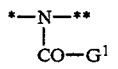

Formula (N-2)

In the formulas, symbol ** represents the position which is bonded to B, and symbol * represents the position which is bonded to one of the free bonds of $-(Y=Z)_m-$.

In the formulas, $G^1$ represents an aliphatic group, an aromatic group or a heterocyclic group.

Of the groups which are represented by the formula (R-1), preferable are those which are represented by the following formulas (R-2) and (R-3):

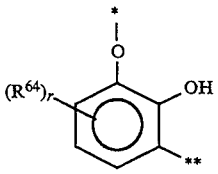

Formula (R-2)

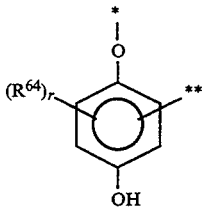

Formula (R-3)

In the formulas (R-2) and (R-3), the mark * indicates the position where the group bonds to G of formulas (I), and the mark ** indicates the position where it bonds to X.

In these formulas, $R^{64}$ is a substituent group, and r is 0, 1, 2 or 3. If r is 2 or 3, the groups $R^{64}$ may be the same or different. If two substituent groups $R^{64}$ are on adjacent carbon atoms, they may change to divalent groups, which bond together to form a ring-like structure.

In the formula (I), X represents a development inhibitor. Preferable examples of X are a compound having a mercapto group which bonds to the heterocyclic ring which represented by the following formula (X-1), or a heterocyclic compound which can form imino silver which represented by the following formula (X-2).

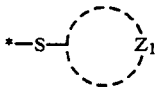

Formula (X-1)

-continued

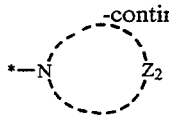

Formula (X-2)

In the formulas (X-1) and (X-2), $Z_1$ is a non-metal atom group required for forming a monocyclic or condensed heterocyclic ring, $Z_2$ is a non-metal atom group required for forming, along with N, a monocyclic or condensed heterocyclic ring. The heterocyclic ring may have a substituent group. In the formulas (X-1) and (x-2), the mark * indicates the position where the compound X bonds to Time. Preferable as a heterocyclic ring is formed by $Z_1$ or $Z_2$ are 5- to 8-membered heterocyclic rings, each having at least one hetero atom such as a nitrogen atom, an oxygen atom, a sulfur atom, or a selenium atom. Of these, the most preferred is a 5- or 6-membered heterocyclic ring.

Examples of the heterocyclic ring represented by $Z_1$ are: azoles (tetrazole, 1,2,4-triazole, 1,2,3-triazole, 1,3,4-thiadiazole, 1,3,4-oxadiazole, 1,3-thiazole, 1,3-oxazole, imidazole, benzothiazole, benzoxazole, benzimidazole, pyrrole, pyrazole, and indazole), azaindenes (tetraazaindene, pentaazaindene, and triazaindene), and azines (pyrimidine, triazine, pyrazine, and pyridazine).

Examples of the heterocyclic ring represented by $Z_2$ are: triazoles (1,2,4-triazole, benzotriazole, and 1,2,3-triazole), indazole, benzimidazole, azaindenes (tetraazaindene and pentaazaindene), and tetrazole.

Preferable as the substituent group which the development inhibitors presented by the formula (X-1) and (X-2) have are: $R^{77}$ group, $R^{78}O-$ group, $R^{77}S-$ group, $R^{77}OCO-$ group, $R^{77}OSO_2-$ group, a halogen atom, a cyano group, a nitro group, $R^{77}SO_2-$ group, $R^{78}CO-$ group, $R^{77}COO-$ group, $R^{77}SO_2N(R^{78})-$ group, $R^{78}N(R^{79})SO_2-$group, $R^{18}N(R^{79})CO-$ group, $R^{77}C(R^{78})=N-$ group, $R^{77}N(R^{78})-$ group, $R^{78}CON(R^{79})-$ group, $R^{77}OCON(R^{78})-$ group, $R^{78}N(R^{79})CON(R^{80})-$ group, or $R^{77}SO_2O-$ group, or a group represented below.

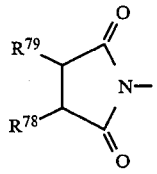

or

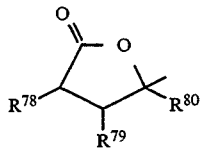

Here, $R^{77}$ is an aliphatic group, an aromatic group, a heterocyclic group, or a hydrogen atom. If there are two or more $R^{77}$ groups, two or more $R^{78}$ groups, two or more $R^{79}$ groups, and two or more $R^{80}$ groups, these may bond together, forming a ring (e.g., a benzene ring).

Examples of the compound represented by the formula (X-1) are: substituted or unsubstituted mercaptoazoles (e.g., 1-phenyl-5-mercaptotetrazole, 1-propyl-5-mercaptotetrazole, 1-butyl-5-mercaptotetrazole, 2-methylthio-5-mercaptol,3,4-thiadiazole, 3-methyl-4-phenyl-5-mercapto-l,3,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido) phenyl}-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (e.g., 6-methyl-4-mercapto-1,2,3*a*,7-tetraazaindene and 4,6-dimethyl-2-mercapto-1,3,3*a*,7-tetraazaindene), and substituted or unsubstituted mercaptopyrimidines (e.g., 2-mercaptopyrimidine and 2-mercapto-4-methyl-6-hydroxypyrimidine).

Examples of the heterocyclic compound which can form imino silver are: substituted or unsubstituted triazoles (e.g., 1,2,4-triazole, benzotriazole, 5-methylbenzotriazole, 5-nitrobenzotriazole, 5-bromobenzotriazole, 5-n-butylbenzotriazole, and 5,6-dimethylbenzotriazole), substituted or unsubstituted indazoles (e.g., indazole, 5-nitroindazole, 3-nitroindazole, and 3-chloro-5-nitroindazole), and substituted or unsubstituted benzimidazoles (e.g., 5-nitrobenzimidazole and 5,6-dichlorobenzimidazole).

In the formula (I), X may be a development inhibitor which leaves Time, becoming a development-inhibiting compound, and then reacts with a developing component in a specific manner, changing to a compound which cannot inhibit development or can inhibit development but very little. A functional group which undergo such chemical reaction is, for example, ester group, carbonyl group, imino group, immonium group, a Michael addition receptor group, or imido group.

Groups which can be cited as examples of such a deactivated development inhibitor are the development-inhibiting residual groups described in, for example, U.S. Pat. Nos. 4,477,563, JP-A-60-218644, JP-A-60-221750, JP-A-60-233650, and JP-A-61-11743.

Of these compounds, any having ester is preferred. Examples of such a compound are: 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-phenoxycarbonylbenzotriazole, 5-(4-cyanophenoxycarbonyl)benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 6-phenoxycarbonyl-2-mercatobenzoxazole, 2-(1-methoxycarbonylethylthio)-5-mercapto-1,3,4-thiadiazole, 2-butoxycarbonylmethoxycarbonyl-methylthio-5-mercapto-1,3,4-thiadiazole, 2-(N-hexylcarbamoylmethoxycarbonylmethylthio)-5-mercapto-l,3,4-thiadiazole, and 5-butoxycarbonylmethoxycarbonylbenzotriazole.

Of the compounds represented by the formula (I), preferable are those represented by the following formulas (II) and (III):

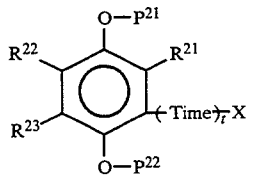

Formula (II)

wherein $R^{21}$ to $R^{23}$ are groups which can be substituted with hydrogen atoms or hydroquinone nuclei, $p^{21}$ and $p^{22}$ are hydrogen atoms or protective groups which can leave at the time of development, and "Time", X, and t are of the same meaning as in the formula (I) .

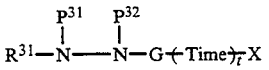

Formula (III)

wherein $R^{31}$ is an aryl group, a heterocyclic group, an alkyl group, an aralkyl group, an alkenyl group, or an alkynyl group, $p^{31}$ and $p^{32}$ are hydrogen atoms or protective groups which can leave at the time of development, G, "Time", X, and t are of the same meaning as in the formula (I).

The formula (II) will be described in greater detail. The substituent groups represented by $R^{21}$ to $R^{23}$ can be those exemplified as substituent groups for A in the formula (I). Nonetheless, preferable as $R^{22}$ to $R^{23}$ are: a hydrogen atom, an alkylthio group, an arylthio group, an alkoxy group, an aryloxy group, an amido group, a sulfonamido group, an alkoxycarbonylamino group, and an ureido group. Of these, particularly preferable are: a hydrogen atom, an alkylthio group, an alkoxy group, an amido group, a sulfonamido group, an alkoxycarobnylamino group, and an ureido group. $R^{22}$ and $R^{23}$ may be bonded to each other to form a ring.

Preferable as $R^{21}$ are: a hydrogen atom, a carbamoyl group, an alkoxycarbonyl group, a sulfamoyl group, a sulfonyl group, a cyano group, an acyl group, and a heterocyclic group. Of these, particular preferable are: a hydrogen atom, a carbamoyl group, an alkoxycarbonyl group, a sulfamoyl group, and a cyano group.

Examples of protective groups $R^{21}$ and $R^{22}$ may be those exemplified above as protective groups for the hydroxy group of A in the formula (I). Preferable as the protective groups are: a group which can be decomposed by hydrolysis, such as an acyl group, an alkoxycarbonyl group, an aryloxycabonyl group, a carbamoyl group, an imidoyl group, an oxazolyl group, or a sulfonyl group; a precursor group of the type disclosed in U.S. Pat. No. 4,009,029 and utilizing reverse Mickael reaction; a precursor group of the type disclosed in U.S. Pat. No. 4,310,612 and utilizing an anion generated after ring-cleavage reaction, as an intramolcular nucleophilic group; a precursor group of the type disclosed in U.S. Pat. Nos. 3,674,478, 3,932,480 and 3,993,661 and causing cleavage reaction due to the motion of anion electrons along a conjugate system; a precursor group of the type disclosed in U.S. Pat. No. 4,335,200 and causing cleavage reaction due to the motion of the electron of an anion which had reacted after ring-cleavage; and a precursor group of the type disclosed in U.S. Pat. Nos. 4,363,865 and 4,410,618 and utilizing an imidomethyl group.

Preferable as $p^{21}$ and $p^{22}$ are hydrogen atoms.

Preferable as X are mercaptoazoles and benzotriazoles. Particularly preferable mercaptoazoles are mercaptotetrazoles, 5-mercapto-1,3,4-thiadiazoles, and 5-mercapto-1,3,4-oxadiazoles.

The most preferable as X is 5-mercapto-1,3,4thiadiazole.

Of the compounds represented by the formula (II), particularly preferred are those represented by the following formulas (IIa) and (IIb):

Formula (IIa)

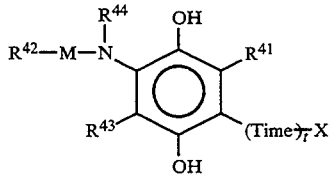

Formula (IIb)

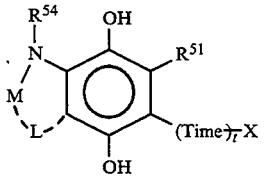

In the formulas (IIa) and (IIb), $R^{42}$ is an aliphatic group, an aromatic group or a heterocyclic group, M is —CO—, —$SO_2$—, —N($R^{45}$)—CO—, —O—CO— or —N($R^{45}$)—$SO_2$. $R^{44}$, $R^{45}$, and $R^{54}$ are each a hydrogen atom, an alkyl group, or an aryl group. L is a divalent linking group required for forming a 5- to 7-membered ring. $R^{41}$ and $R^{51}$ are of the same meaning as $R^{21}$ in the formula (II), $R^{43}$ is of the same meaning as $R^{23}$ in the formula (II), $-(Time)_t-X$ is of the same meaning as $-(Time)_t-X$ in the formula (II).

$R^{42}$ will be described in more detail. If $R^{42}$ is an aliphatic group, it is an alkyl, alkenyl or alkynyl group in the form of a straight chain, a branched chain, or a ring having 1 to 30 carbon atoms. If it is an aromatic group, it is a phenyl or naphthyl group having 6 to 30 carbon atoms. If it is a heterocyclic group, it is a 3- to 12-membered one having at least one element selected from the group consisting of nitrogen, oxygen and sulfur. Group $R^{42}$ may be substituted with any group exemplified above as substituent groups for A.

The formula (III) will be described in more detail.

If $R^{31}$ is an aryl group, it has 6 to 20 carbon atoms and is, for example, phenyl or naphthyl. If it is a heterocyclic group, it is a 5- to 7-membered one having at least one element selected from the group consisting of nitrogen, oxygen and sulfur and is, such as furyl or pyridyl. If it is an alkyl group, it has 1 to 30 carbon atoms and is, for example, methyl, hexyl, or octadecyl. If it is an aralkyl group, it has 7 to 30 carbon atoms and is, for example, benzyl or trityl. If it is an alkenyl group, it has 2 to 30 carbon atoms and is, for example, allyl. If it is an alkynyl group, it has 2 to 30 carbon atoms and is, for example, propagyl. R31 is preferably an aryl group, and more preferably phenyl.

Examples of the protective groups $p^{31}$ and $p^{32}$ are those which have been ememplified above as protective groups for the amino group of A in the formula (I). Preferable as $p^{31}$ and $p^{32}$ are hydrogen atoms.

Preferable as G is —CO—, and preferable as X is one which has been described in conjunction with the formula (II).

$R^{21}$ and $R^{23}$ in the formula (II), and $R^{31}$ in the formula (III) may each be substituted with a substituent group. This substituent group may be a so-called ballast group or a group adsorbed to silver halide, which will impart anti-diffusability. A ballast group is preferred. If $R^{31}$ is a phenyl group, the substituent group is preferably an electron-donating group, such as a sulfonamido group, a amido group, an alkoxy group, or an ureido group. If $R^{21}$, $R^{22}$, $R^{23}$ or $R^{31}$ has a ballast group, it is particularly desirable that a polar group, such as a hydroxy group, a carboxyl group, or a sulfo group, exist in the molecule.

To describe the present invention more specifically, the compounds represented by the formula (II) will be specified in Table A below. However, the compounds which can be used in the invention are not limited to these.

TABLE A

I-1

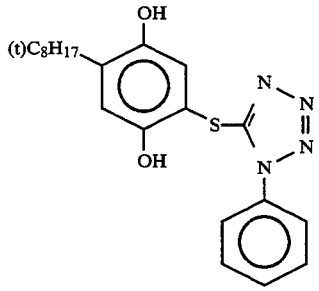

I-2

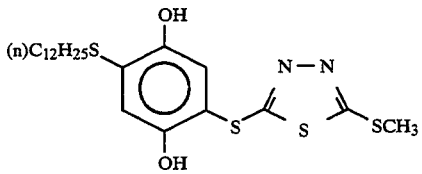

TABLE A-continued
I-3
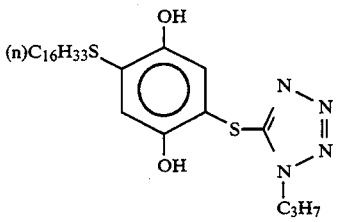
I-4
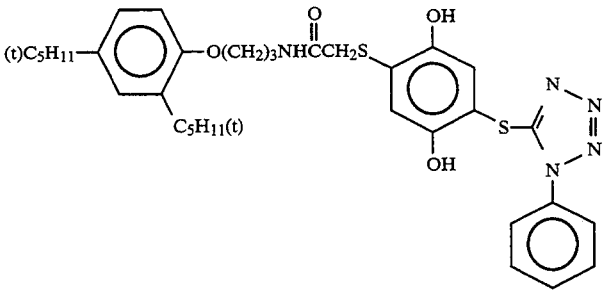
I-5
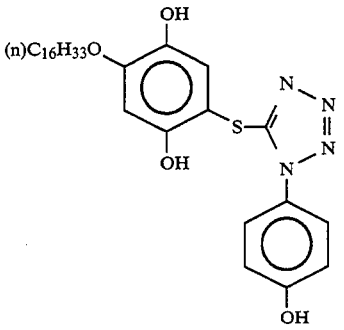
I-6
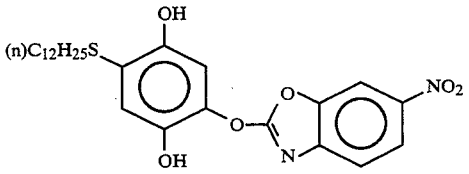
I-7
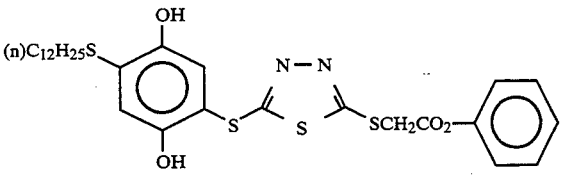
I-8
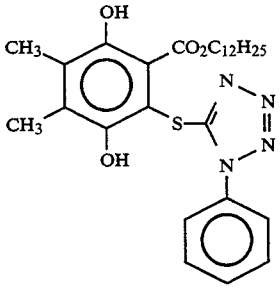

TABLE A-continued
I-9
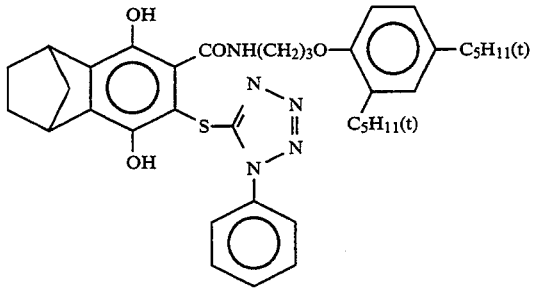
I-10
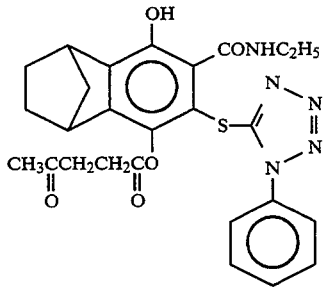
I-11
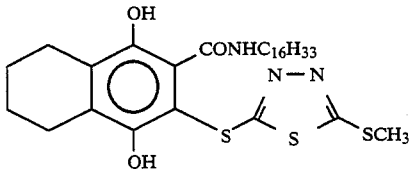
I-12
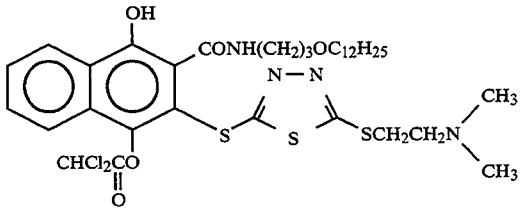
I-13
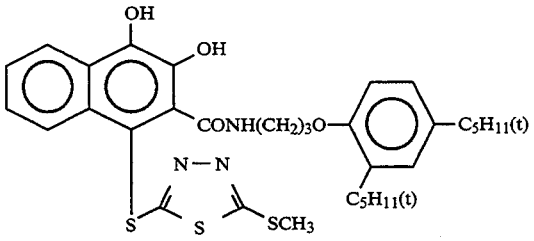
I-14
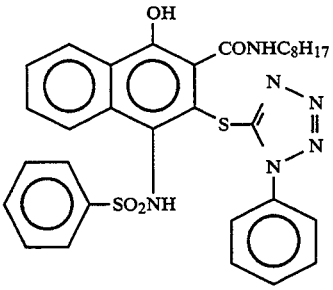

TABLE A-continued
I-15
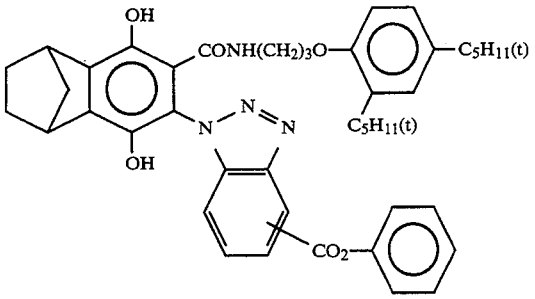
I-16
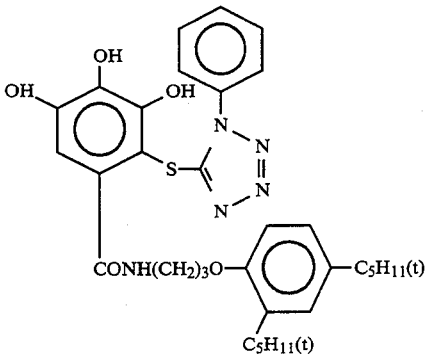
I-17
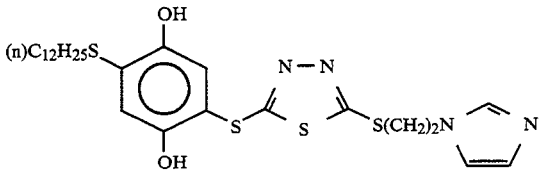
I-18
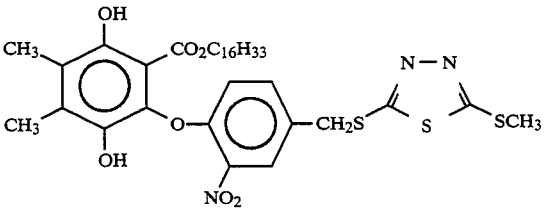
I-19
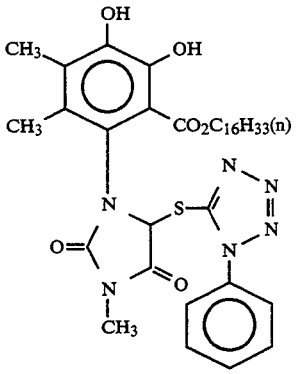

TABLE A-continued
I-20
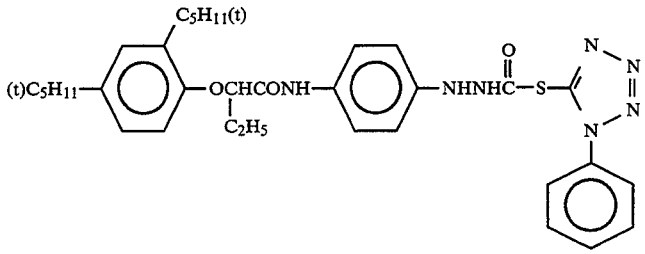
I-21
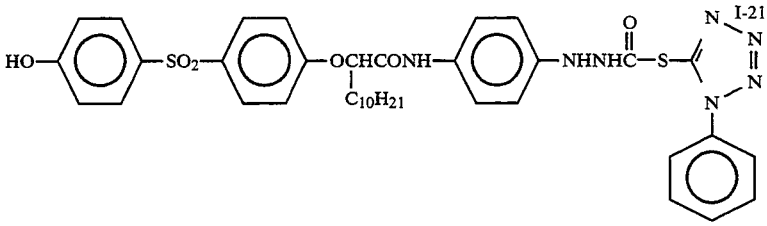
I-22
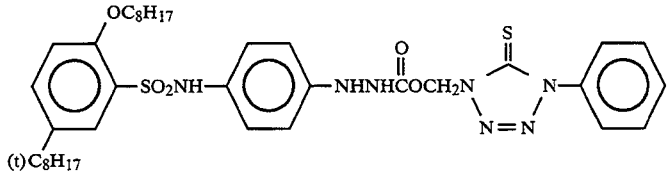
I-23
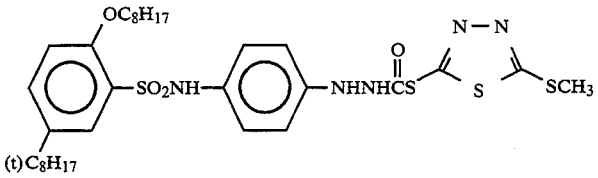
I-24
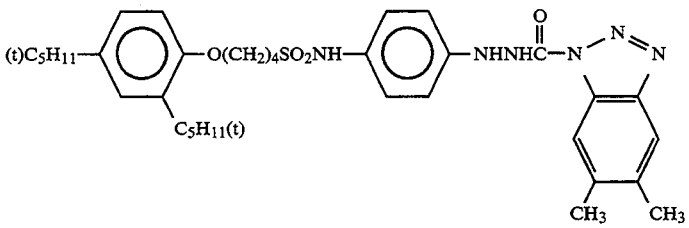
I-25
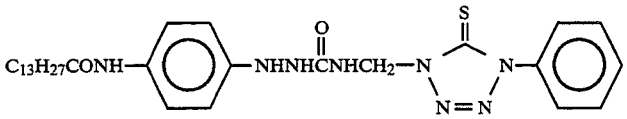
I-26
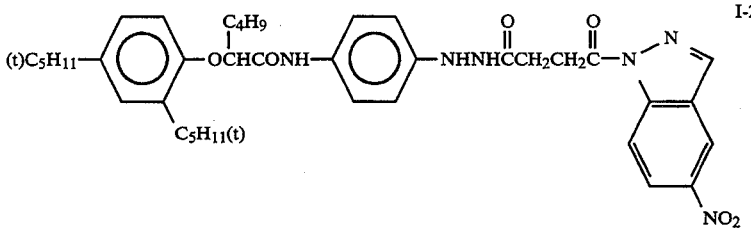

TABLE A-continued
I-27
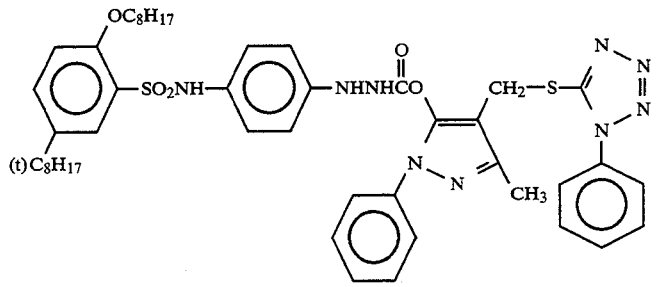
I-28
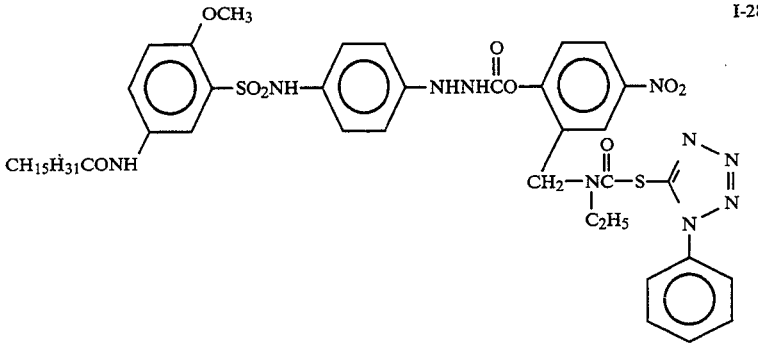
I-29
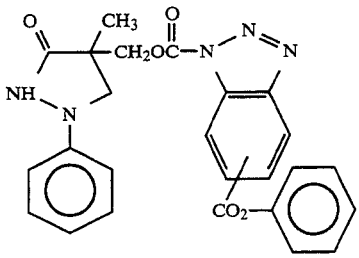
I-30
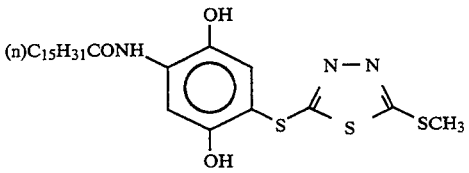
I-31
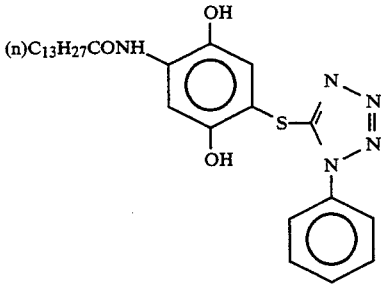
I-32
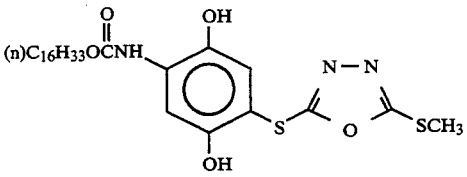

TABLE A-continued
I-33
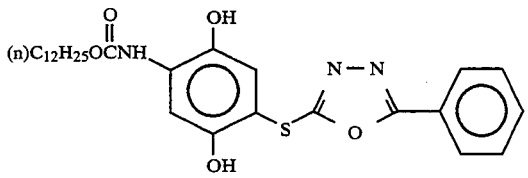
I-34
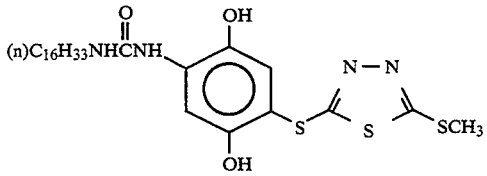
I-35
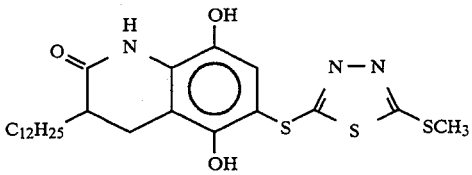
I-36
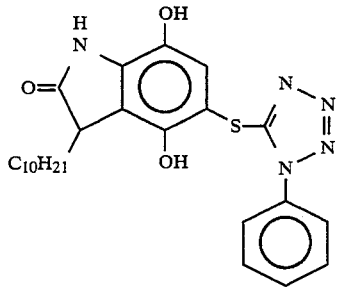
I-37
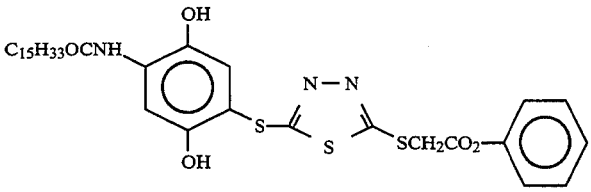
I-38
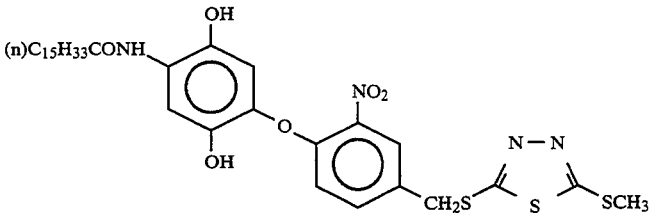
I-39
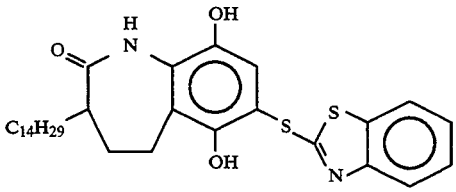
I-40
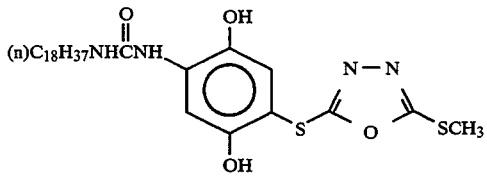

TABLE A-continued
I-41
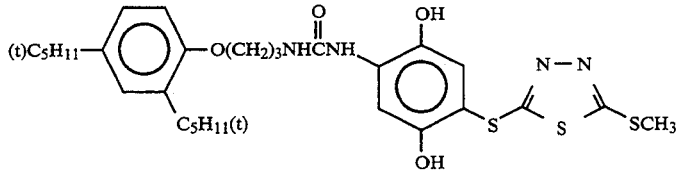
I-42
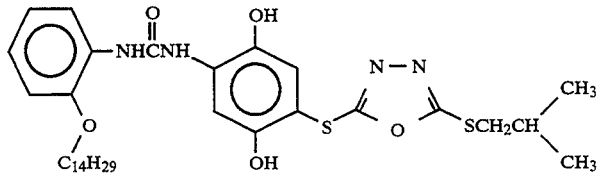
I-43
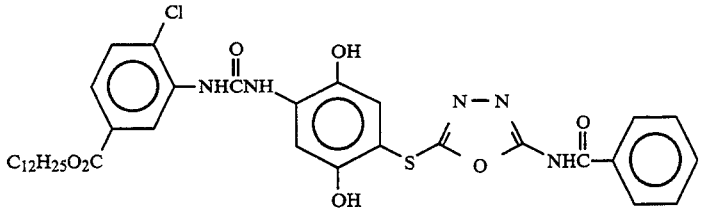
I-44
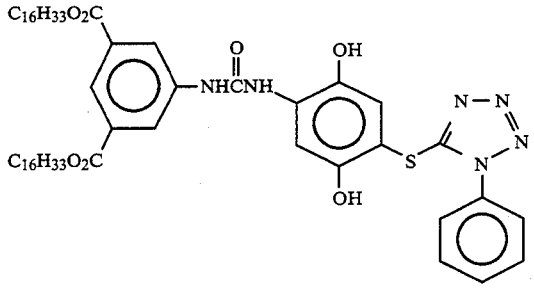
I-45
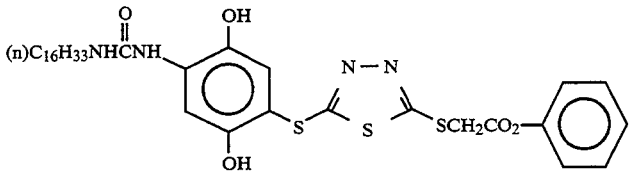
I-46
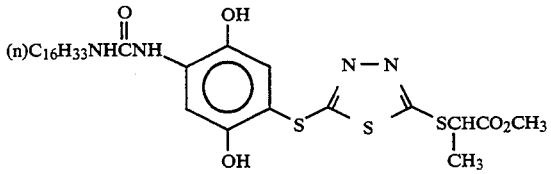
I-47
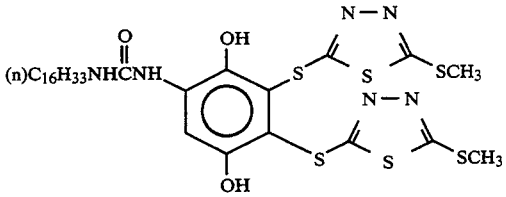
I-48
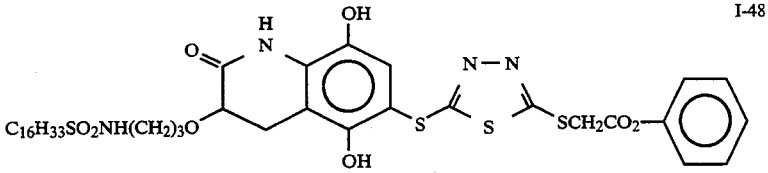

TABLE A-continued
I-49
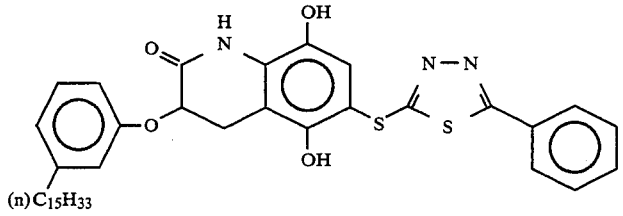
I-50
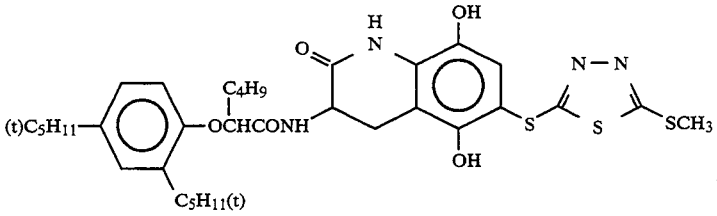
I-51
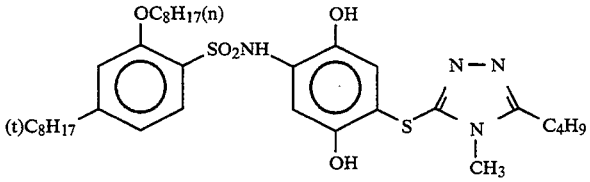
I-52
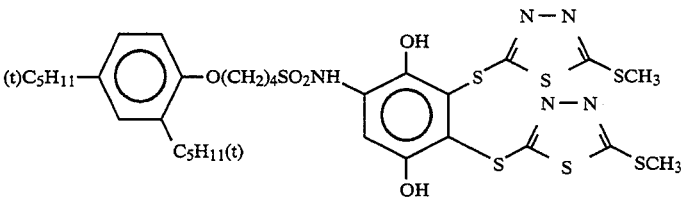
I-53
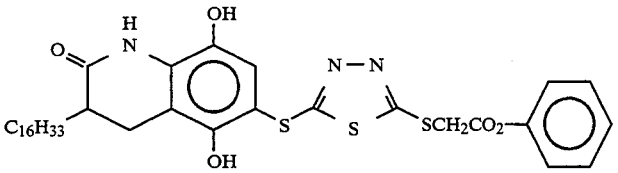
I-54
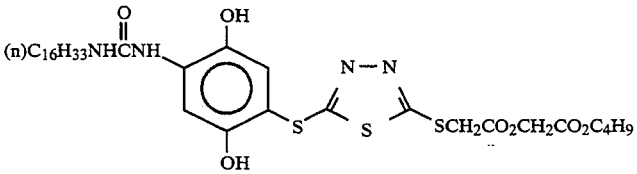
I-55
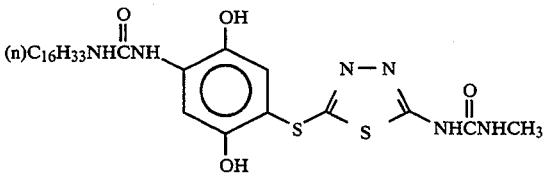
I-56
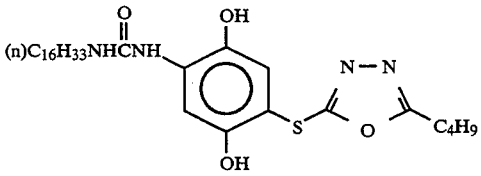

TABLE A-continued
I-57
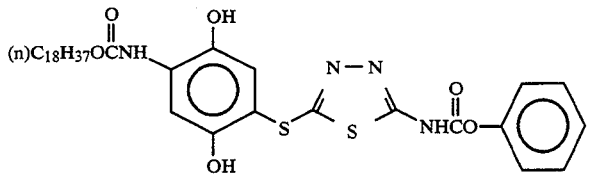
I-58
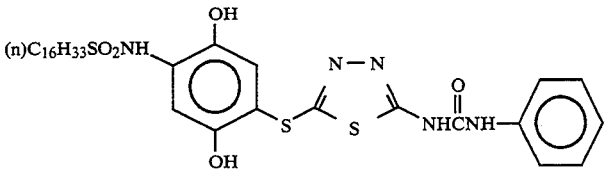
I-59
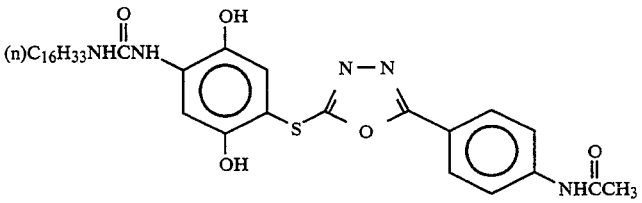
I-60
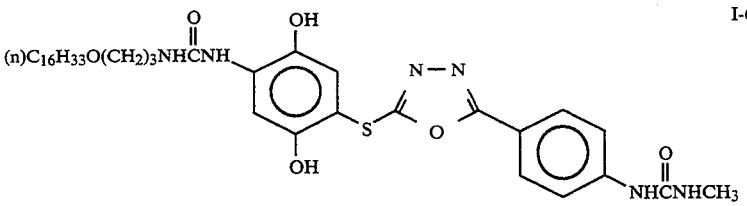
I-61
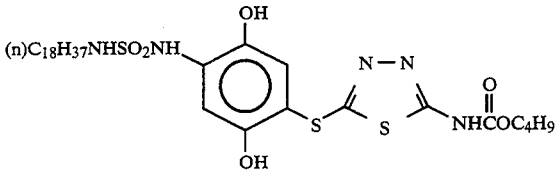
I-62
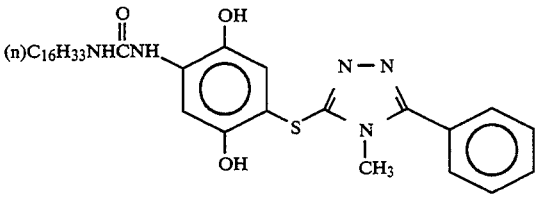
I-63
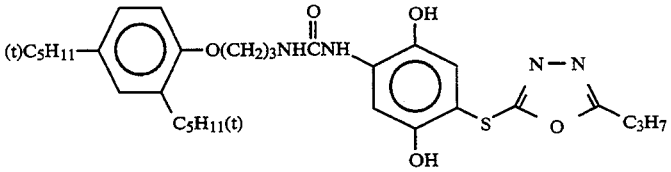
I-64
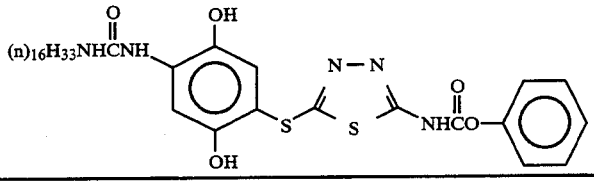
The compound represented by the formula (I) can be synthesized by the methods disclosed in JP-A-49-129536, JP-A-52-57828, JP-A-60-21044, JP-A-60-233642, JP-A-60-233648, JP-A-61-18946, JP-A-61-156043, JP-A-61-213847, JP-A-61-230135, JP-A-61-236549, JP-A-62-62352, JP-A-62-103639, U.S. Pat. Nos.

3,379,529, 3,620,746, 4,332,828, 4,377,634, and 4,684,604.

The compound represented by the formula (I) can be added to any emulsion layer or any non-light-sensitive layer, or both. It is added in an amount of preferably 0.001 to 0.2 mmol/$m^2$, more preferably 0.01 to 0.1 mmol/$m^2$.

In the light-sensitive material of the present invention, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide containing about 30 mol% or less of silver iodide. The most preferable silver halide is silver bromoiodide or silver chlorobromoiodide containing about 2 mol% to about 10 mol% of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/-shell internal latent image type emulsion is described in JP-A-59-133542. Although the thickness of a shell of this emulsion changes in accordance with development or the like, it is preferably 3 to 40 nm, and most preferably, 5 to 20 nm. It is also preferably to use the internal image type emulsion into the layer adjacent to a yellow colloidal silver.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

In the light-sensitive material of the present invention, two or more types of emulsions different in at least one of features such as a grain size, a grain size distribution, a halogen composition, a grain shape, and sensitivity can be mixed and used in the same layer.

In the present invention, a non-light-sensitive fine grain silver halide is preferably used. The nonlight-sensitive fine grain silver halide means silver halide fine grains not sensitive upon imagewise exposure for obtaining a dye image and essentially not developed in development.

The fine grain silver halide contains 0 to 100 mol% of silver bromide and may contain silver chloride and/or silver iodide as needed. Preferably, the fine grain silver halide contains 0.5 to 10 mol% of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral-sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

Various color couplers can be used in the silver halide color photographic light-sensitive material of the present invention, and specific examples of these couplers are described in patents described in the above-mentioned RD No. 17643, VII-C to VII-G and RD No. 307105, VII-C to VII-G.

Examples of yellow couplers are preferably benzoylacetanilide type and pivaloylacetanilide type ones, and preferable yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984 ), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Patents 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers usable in the present invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glycerol-tributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl phydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper. The present invention can also be particularly preferably applied to a color duplicate film.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching $\frac{1}{2}$ of the saturated film thickness.

The film swell speed $T_{\frac{1}{2}}$ can be adjusted by adding a film hardening agent to gelatin as a binder or changing aging conditions after coating.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)anline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl-)aniline, 4-amino-3-methyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and the sulfates, hydrochlorides and p-toluenesulfonates thereof. Of these compounds, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(3-hydroxybutyl)aniline, and the sulfates, hydrochlorides and p-toluenesulfonates thereof are preferred in particular. Of these, 4-amino-3-methyl-N-ethyl-N-(3-hydroxybutyl)aniline and the salts thereof are most preferred since they exhibit high color-forming properties and provide a certain color density even if the amount of developed silver is small, and thus can shorten the development time or improve the desilvering. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture = [contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; 10 quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 10 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in west German Patents 966,410 and 2,748,430; polyamine compounds described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of intensifying the stirring are a method of colliding a Jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39784.

EXAMPLES

The present invention will be described in more detail below by way of its examples, but the present invention is not limited to these examples.

EXAMPLE 1

Preparation of Emulsions (Reparation of Emulsion G)

First, 800 cc of a 15% $AgNO_3$ aqueous solution and an aqueous solution containing 0.85 mol/liter of KBr and 0.031 mol/liter of KI were added over 50 minutes by double jet method to 1,560 cc of 3.4 gelatin aqueous solution maintained at 75° C., while maintaining the pH value at 6.8 and the silver potential (SCE) at +90 mV. As a result, monodisperse cubic core grains, each having edges 0.27 μm long, were formed. Next, 2.0 mg of sodium cloroaurate used as gold sensitizer, 7.0 mg of compound A-2 specified below, and 0.1 mg of compound A-3 specified below were added to the core grains and chemical sensitization was carried out for 40 minutes at pH value of 6.8 and silver potential of +100 mV. The, 0.14 g of compound A-1 specified below and 0.2 g of compound A-4 specified below were added, and the temperature was lowered to 50° C. Further, 200 cc of 15% $AgNO_3$ aqueous solution and the aqueous solution containing 0.85 mol/liter of KBr and 0,004 mol/liter of KI were added over 5 minutes at pH value of 6.8 and silver potential of +10 my, thereby precipitating shells. As a result, monodisperse cubic grains were formed which had an average edge length of 0.28 μm and an average silver iodide content of 3.5 mol%. Soluble silver salt was removed from these grains by passing through an ultrafiltration membrance, thereby preparing internal latent-image emulsion (emulsion G) having pH and pAg values of 6.2 and 8.4, respectively. The variation coefficient of this emulsion, in terms of the distribution of gain size (i.e., edge length), was 8%. (Said variation was a value obtained by multiplying the ratio of the standard deviation of the distribution to the average distribution.) The variation coefficient of distribution of silver iodide contents was 5%. The gains thus formed had such crystal habit that (100) faces amounted to 99%, and (111) faces amounted to 10%.

(Preparation of Emulsion I)

First, 2.75 cc of $AgNO_3$ aqueous solution (containing 32 g of $AgNO_3$, 0.7 g of gelatin having an average molecular weight ($\overline{M}$) of 20,000, 0.14 cc of $NHO_3$(1N), per 100 cc) and 27.5 cc of KBr aqueous solution (containing 0.7 g of gelatin having an average molecular weight ($\overline{M}$) of 20,000, per 100 cc) were added, each at the rate of 25 cc/min, to 1 liter of aqueous solution containing 7 g of gelatin having an average molecular weight ($\overline{M}$) of 20,000 and 4.5 g of KBr, while stirring the gelatin solution. The temperature was 30° C. Of this emulsion, 350 ml was used as seed crystals. To this part of the emulsion, there was added 650 ml of a gelatin aqueous solution (containing 20 g of gelatin and 1.2 g of KBr). The resultant solution was heated to 75° C. and was ripened for 40 minutes. Thereafter, $AgNO_3$ aqueous solution (containing 1.7 g of $AgNO_3$) was added over 1 minutes 30 seconds. Next, 6.2 ml of $NH4HO_3$ aqueous solution (25 wt %) and 6.2 ml of $NH_3$ aqueous solution were added, and the resultant solution was ripened for 40 minutes.

Next, after the pH of the emulsion was maintained to 7.0 and 1 g of KBr was added, $AgNO_3$ solution (containing 10 g of $AgNO_3$ per 100 ml) and KBr solution are added in by the CDJ addition having a silver potential of −20 mV for the first 10 minutes at 8 ml/min, then for the next 20 minutes at 15 ml/min. At the point when 80% of the total amount of $AgNO_3$ was added, the addition of the $AgNO_3$ and KBr solutions was once stopped. Then, the temperature and the silver potential were changed to 50° C. or −60 my, respectively, and 830 ml of a K1 solution was added over a time period of about 10 minutes. In the meantime, at the time when 50% of the total amount of $AgNO_3$ was added, the below-mentioned compound A-3, and at the time when 90% of the total amount was added, KSCN was added. The emulsion was desalted by an ultrafiltration membrane, washed by water, and dispersed again. The average grain diameter, the average thickness, and the average aspect ratio of the grains in the emulsion were 1.1 μm, 0.16 μm, and 6.7, respectively. To the emulsion, added were the sensitization dye and the below compound A-6 at 40° C. as indicated in Tables 2 and 3, and then the below compound A-2 and potassium chloroaurate at 70° C. The emulsion was subjected to chemical sensitization for 80 minutes. Further, after the below compounds A-1 and A-4 were added, another emulsion of fine-grains having an average diameter of 0.08° C. and silver iodide content of 1.2 mol% was added to cover the surface of each grain, thereby obtaining emulsion I.

(Preparation of Other Emulsions)

Various types of each of tabular-grain emulsion, and regular-crystal emulsion were prepared from emulsions G and I by the general method with variable conditions including grain size, grain shape, AgI content, chemical sensitization method, sensitization dye, and dye adding method, as specified in Tables 1, 2, and 3.

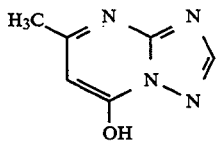

A-1

-continued

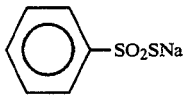

A-2

$K_2IrCl_6$ A-3

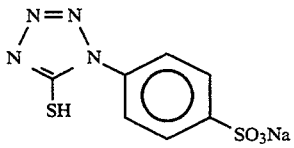

A-4

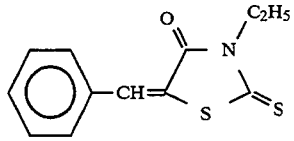

A-5

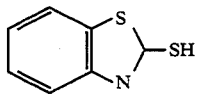

A-6

Forming of Sample 101

A multilayered color light-sensitive material constituted by layers having the following compositions was formed on an undercoated 127 μm thick triacetylcellulose film support, thereby obtaining Sample 101. Numerals indicate an addition amount per $m^2$. Note that the effects of the added compounds are not limited to those described here.

| | |
|---|---|
| Layer 1: Antihalation layer | |
| Black colloidal silver | silver 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Dispersed fine crystals in dye E-1 | 0.1 g |
| Layer 2: Interlayer | |
| Gelatin | 0.40 g |
| Compound Cpd-C | 5 mg |
| Compound Cpd-I | 5 mg |
| Compound Cpd-J | 3 mg |
| High boiling organic solvent Oil-3 | 0.1 g |
| Dye D-4 | 0.8 mg |
| Layer 3: Interlayer | |
| Yellow colloidal silver | silver 0.01 g |
| Gelatin | 0.4 g |
| Layer 4: Low red-sensitive emulsion layer | |
| Emulsion A | silver 0.3 g |
| Emulsion B | silver 0.2 g |
| Emulsion O | silver 0.1 g |
| Gelatin | 0.8 g |
| Coupler C-1 | 0.15 g |
| Coupler C-2 | 0.05 g |
| Compound Cpd-C | 5 mg |
| Compound Cpd-I | 5 mg |
| High-boiling organic solvent Oil-2 | 0.1 g |
| Additive P-1 | 0.1 g |
| Layer 5: Medium red-sensitive emulsion layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| High-boiling organic solvent Oil-2 | 0.1 g |
| Additive P-1 | 0.1 g |
| Layer 6: High red-sensitive emulsion layer | |

-continued

| | |
|---|---|
| Emulsion D | silver 0.4 g |
| Gelatin | 1.1 g |
| Coupler C-1 | 0.3 g |
| Coupler C-2 | 0.1 g |
| Coupler C-5 | 0.02 g |
| Additive P-1 | 0.1 g |
| Layer 7: Interlayer | |
| Gelatin | 0.6 g |
| Additive M-1 | 0.3 g |
| Color-mixing inhibitor Cpd-I | 2.6 mg |
| Dye D-5 | 0.02 g |
| Compound Cpd-I | 5 mg |
| High-boiling organic solvent Oil-1 | 0.02 g |
| Layer 8: Interlayer | |
| Yellow colloidal silver | silver 0.005 g |
| Gelatin | 1.0 g |
| Additive P-1 | 0.2 g |
| Color-mixing inhibitor Cpd-A | 0.1 g |
| Compound Cpd-C | 0.1 g |
| Compound Cpd-M | 3.0 mg |
| Layer 9: Low green-sensitive emulsion layer | |
| Emulsion E | silver 0.1 g |
| Emulsion F | silver 0.2 g |
| Emulsion G | silver 0.2 g |
| Gelatin | 0.5 g |
| Coupler C-3 | 0.1 g |
| Coupler C-6 | 0.05 g |
| Coupler C-7 | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-I | 10 mg |
| Compound Cpd-K | 0.02 g |
| High-boiling organic solvent Oil-1 | 0.1 g |
| High-boiling organic solvent Oil-2 | 0.1 g |
| Layer 10: Medium green-sensitive emulsion layer | |
| Emulsion G | silver 0.3 g |
| Emulsion H | silver 0.1 g |
| Emulsion O | silver 0.08 g |
| Gelatin | 0.6 g |
| Coupler C-3 | 0.1 g |
| Coupler C-6 | 0.2 g |
| Coupler C-7 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-K | 0.05 g |
| High-boiling organic solvent Oil-2 | 0.01 g |
| Layer 11: High green-sensitive emulsion layer | |
| Emulsion I | silver 0.5 g |
| Gelatin | 1.0 g |
| Coupler C-3 | 0.3 g |
| Coupler C-6 | 0.1 g |
| Coupler C-7 | 0.1 g |
| Compound Cpd-B | 0.08 g |
| Compound Cpd-E | 0.02 g |
| Compound Cpd-F | 0.04 g |
| Compound Cpd-J | 5 mg |
| Compound Cpd-K | 0.02 g |
| High-boiling organic solvent Oil-1 | 0.02 g |
| High-boiling organic solvent Oil-2 | 0.02 g |
| Layer 12: Interlayer | |
| Gelatin | 0.6 g |
| Compound Cpd-K | 0.05 g |
| High-boiling organic solvent Oil-1 | 0.05 g |
| Layer 13: Yellow filter layer | |

-continued

| | |
|---|---|
| Yellow colloidal silver | silver 0.07 g |
| Gelatin | 1.1 g |
| Color-mixing inhibitor Cpd-A | 0.01 g |
| Compound Cpd-K | 0.01 g |
| High-boiling organic solvent Oil-1 | 0.01 g |
| Dispersed fine crystals in dye E-2 | 0.05 g |
| Layer 14: Low blue-sensitive emulsion layer | |
| Emulsion J | silver 0.2 g |
| Emulsion K | silver 0.3 g |
| Gelatin | 0.8 g |
| Coupler C-4 | 0.2 g |
| Coupler C-5 | 0.1 g |
| Coupler C-8 | 0.4 g |
| Layer 15: Medium blue-sensitive emulsion layer | |
| Emulsion L | silver 0.5 g |
| Gelatin | 0.9 g |
| Coupler C-4 | 0.1 g |
| Coupler C-5 | 0.1 g |
| Coupler C-8 | 0.6 g |
| Layer 16: High blue-sensitive emulsion layer | |
| Emulsion M | silver 0.2 g |
| Emulsion N | silver 0.2 g |
| Gelatin | 1.2 g |
| Coupler C-4 | 0.1 g |
| Coupler C-5 | 0.1 9 |
| Coupler C-8 | 0.6 g |
| High-boiling organic solvent Oil-2 | 0.1 g |
| Layer 17: First protective layer | |
| Gelatin | 0.7 g |
| Ultraviolet absorbent U-1 | 0.02 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.15 g |
| Dye D-2 | 0.05 g |
| Dye D-3 | 0.1 g |
| Layer 18: Second protective layer | |
| Colloidal silver | silver 0.1 mg |
| Fine grain silver iodobromide emulsion (average grain size: 0.06 μm; AgI content: 1 mol %) | silver 0.1 g |
| Gelatin | 0.4 g |
| Layer 19: Third protective layer | |
| Gelatin | 0.4 g |
| Polymethylmethacrylate (average grain size: 1.5 μm) | 0.1 g |
| Copolymer of methylmethacrylate and acrylic acid in the ratio of 4:6 (av. grain size: 1.5 μm) | 0.1 g |
| Silicone oil | 0.03 g |
| Surfactant W-1 | 3.0 mg |
| Surfactant W-2 | 0.03 g |

The compounds used in forming Sample 101 will be identified by their names or chemical formulas, in Table B later presented.

In addition to the above compositions, additives F-1 to F-8 were added to all of the emulsion layers. Furthermore, in addition to the above compositions, a gelatin hardener H-1 and surfactants W-3 to W-6 for coating and emulsification were added to each layer.

Further, as antiseptic and mildewproofing agents, phenol, 1,2-benzisothiazoline-3-one, 2-phenoxyethanol, phenethyl alcohol, and butyl para-benzoate were added.

TABLE 1

Silver bromoiodide emulsion used in sample 101 are as follows:

| Emulsion | Features of grains | Average equivalent-shere diameter (mm) | Variation coefficient of distribution of grain size (%) | AgI content (%) | AgI content on grain surface (%) | Variation coefficient of distribution of AgI content among grains | (111)/(110) face ration |
|---|---|---|---|---|---|---|---|
| A | Monodisperse tetradecahedral grain | 0.24 | 16 | 5.0 | 7.0 | 23 | 35/65 |

TABLE 1-continued

Silver bromoiodide emulsion used in sample 101 are as follows:

| Emulsion | Features of grains | Average equivalent-shere diameter (mm) | Variation coefficient of distribution of grain size (%) | AgI content (%) | AgI content on grain surface (%) | Variation coefficient of distribution of AgI content among grains | (111)/(110) face ration |
|---|---|---|---|---|---|---|---|
| B | Monodisperse octahederal, internal latent-image grains | 0.24 | 10 | 5.0 | 3.0 | 7 | 90/10 |
| C | Monodisperse cubic grains (Used Se sensitizer) | 0.38 | 10 | 5.0 | 3.5 | 15 | 0/100 |
| D | Monodisperse tabular grains Average aspect ratio: 3.0 | 0.68 | 15 | 2.0 | 2.5 | 12 | 95/5 |
| E | Monodisperse cubic grains | 0.18 | 7 | 4.0 | 3.0 | 10 | 8/92 |
| F | Monodisperse tetradecahedral grains | 0.21 | 8 | 4.0 | 3.0 | 6 | 30/70 |
| G | Monodisperse cubic, internal latent-image grain | 0.28 | 8 | 3.5 | 3.0 | 5 | 1/99 |
| H | Monodisperse tetradecahedral grains | 0.40 | 9 | 4.1 | 3.5 | 8 | 20/80 |
| I | Tabular internal latent-image grains Average aspect ratio: 6.7 | 1.10 | 23 | 2.0 | 1.5 | 10 | 99/1 |
| J | Monodisperse cubic grains | 0.30 | 18 | 4.0 | 2.5 | 35 | 1/99 |
| K | Monodisperse tetradecahedral grains | 0.45 | 17 | 4.0 | 3.5 | 40 | 15/85 |
| L | Monodisperse tabular grains Average aspect ratio: 5.0 | 0.55 | 13 | 4.0 | 5.0 | 15 | 94/6 |
| M | Tabular grains Average aspect ratio: 6.0 | 1.00 | 25 | 1.5 | 2.0 | 30 | 99/1 |
| N | Monodisperse tabular grains Average aspect ratio: 9.0 | 1.20 | 17 | 1.5 | 1.3 | 9 | 100/0 |
| O | Monodisperse cubic (surface- and internally fogged silver bromoiodide grains) | 0.06 | 16 | 0.3 | 0.2 | 3 | 10/90 |

TABLE 2

Spectral Sensitization of Emulsion A–I

| Emulsion | Sensitizing dye added | Amount added per 1 mole of silver halide (g) | Timing of addition of sensitizing dye |
|---|---|---|---|
| A | S-2 | 0.025 | During formation of grains |
| | S-3 | 0.25 | |
| | S-8 | 0.01 | |
| B | S-1 | 0.01 | During formation of grains |
| | S-3 | 0.25 | |
| | S-8 | 0.01 | |
| C | S-1 | 0.01 | Before chemical sensitization |
| | S-2 | 0.01 | |
| | S-3 | 0.25 | |
| | S-8 | 0.01 | |
| D | S-2 | 0.01 | Immediately after chemical sensitization |
| | S-3 | 0.10 | |
| | S-8 | 0.01 | |
| E | S-4 | 0.5 | Immediately after chemical sensitization |
| | S-5 | 0.1 | |
| F | S-4 | 0.3 | Immediately after |

TABLE 2-continued

Spectral Sensitization of Emulsion A–I

| Emulsion | Sensitizing dye added | Amount added per 1 mole of silver halide (g) | Timing of addition of sensitizing dye |
|---|---|---|---|
| | S-5 | 0.1 | chemical sensitization |
| G | S-4 | 0.25 | Before chemical sensitization |
| | S-5 | 0.08 | |
| | S-9 | 0.05 | |
| H | S-4 | 0.2 | Immediately after chemical sensitization |
| | S-5 | 0.06 | |
| | S-9 | 0.05 | |
| I | S-4 | 0.3 | After formation of grains but before chemical sensitization |
| | S-5 | 0.07 | |
| | S-9 | 0.1 | |

TABLE 3

| Spectral Sensitization of Emulsion J–N | | | |
|---|---|---|---|
| Emulsion | Sensitizing dye added | Amount added per 1 mole of silver halide (g) | Timing of addition of sensitizing dye |
| J | S-6 | 0.05 | Immediately after chemical sensitization |
| | S-7 | 0.2 | |
| K | S-6 | 0.05 | After formation of grains but before chemical sensitization |
| | S-7 | 0.2 | |
| L | S-6 | 0.06 | After formation of grains but before |
| | S-7 | 0.22 | |

TABLE 3-continued

| Spectral Sensitization of Emulsion J–N | | | |
|---|---|---|---|
| Emulsion | Sensitizing dye added | Amount added per 1 mole of silver halide (g) | Timing of addition of sensitizing dye |
| | | | chemical sensitization |
| M | S-6 | 0.04 | After formation of grains but before chemical sensitization |
| | S-7 | 0.15 | |
| N | S-6 | 0.06 | After formation of grains but before sensitization |
| | S-7 | 0.22 | |

TABLE B

C-1

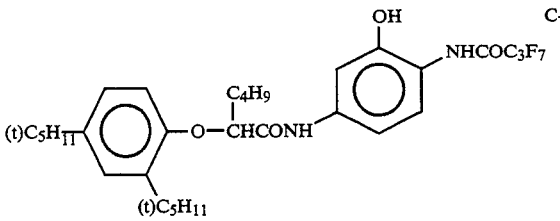

C-2

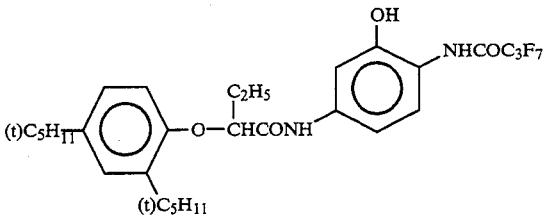

C-3

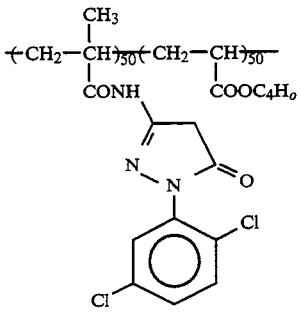

50:50 (wt %)
mol. wt. about 25,000

C-4

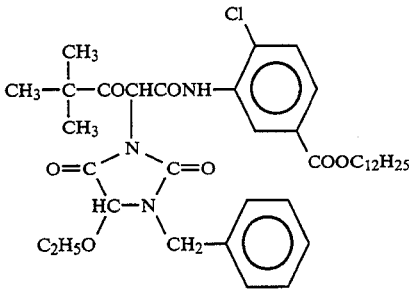

C-5

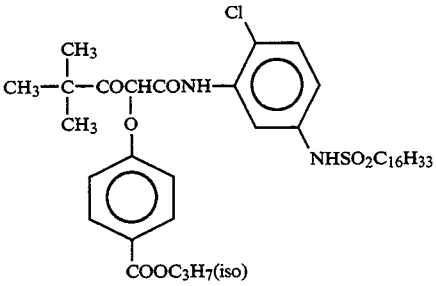

C-6

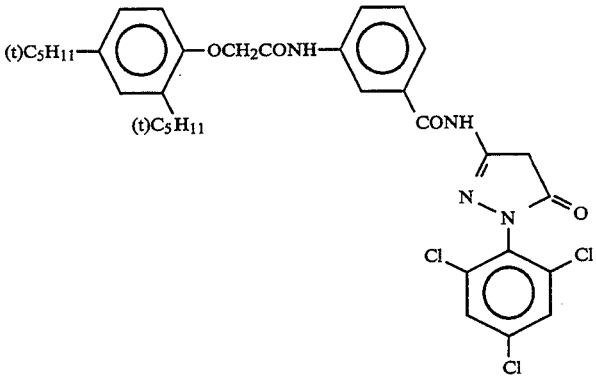

TABLE B-continued
C-7
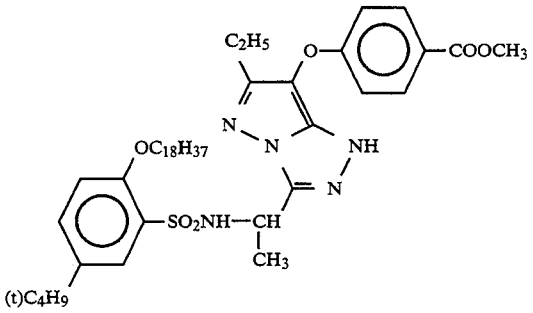
C-8
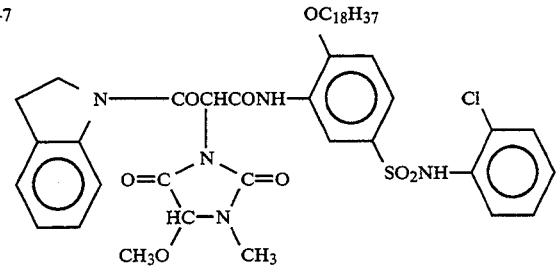
dibutylphtalate Oil-1
tricresylphosphate Oil-2
Oil-3
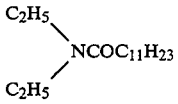
Cpd-A
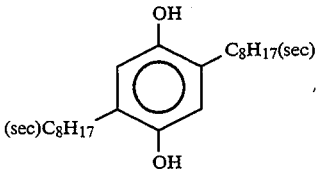
Cpd-B
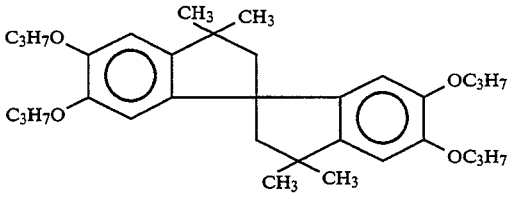
Cpd-C
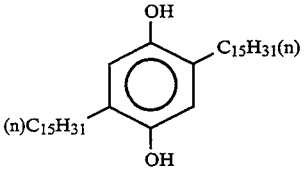
Cpd-D
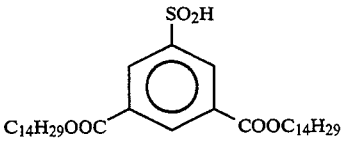
Cpd-E
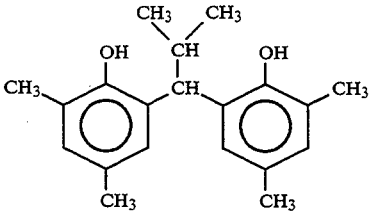
Cpd-F
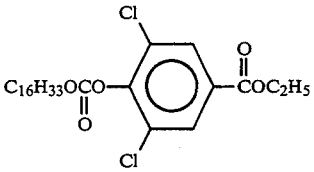
Cpd-G
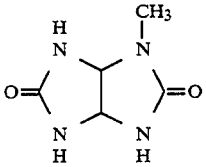
Cpd-H
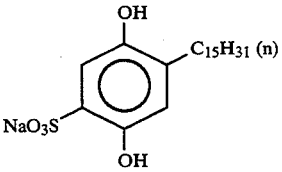
Cpd-I
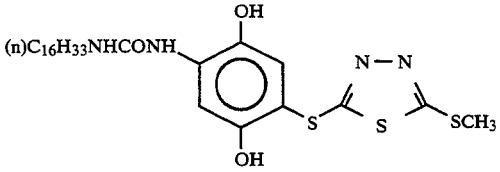
Cpd-J
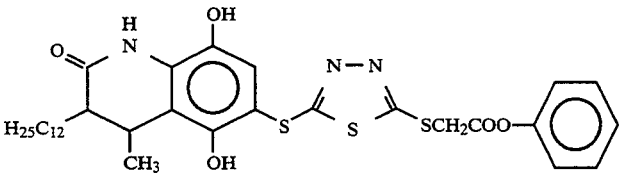
Cpd-K
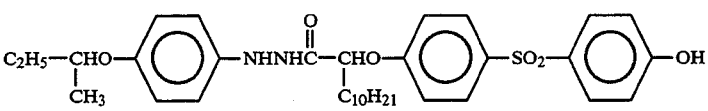

TABLE B-continued
Cpd-L
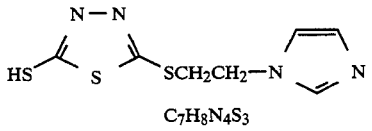
$C_7H_8N_4S_3$
U-1
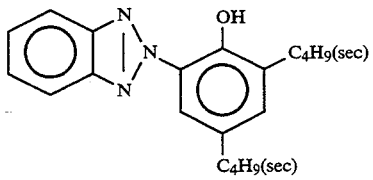
U-2
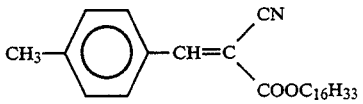
U-3
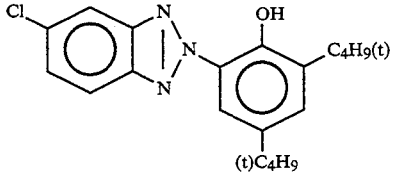
U-4
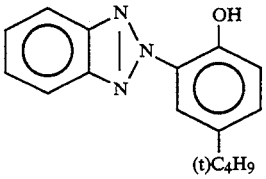
U-5
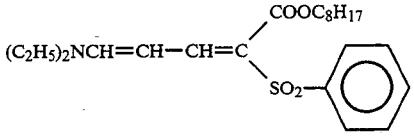
S-1
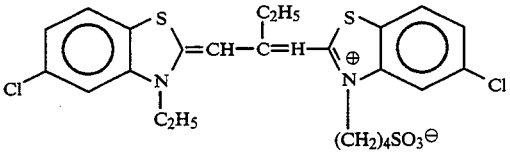
S-2
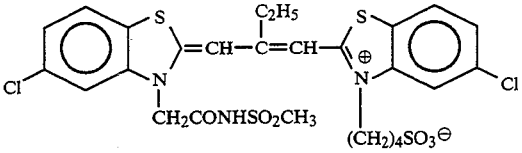
S-3
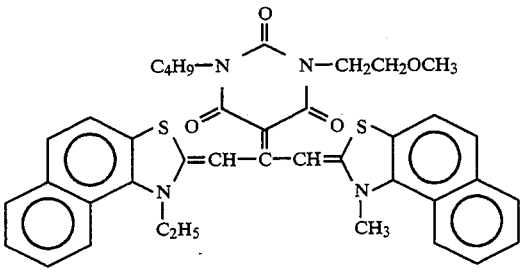
S-4
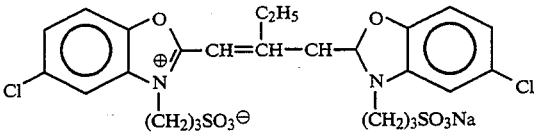
S-5
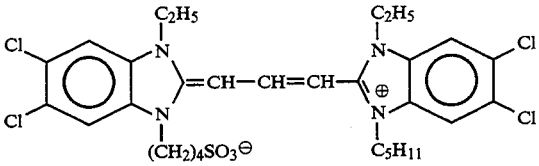
S-6
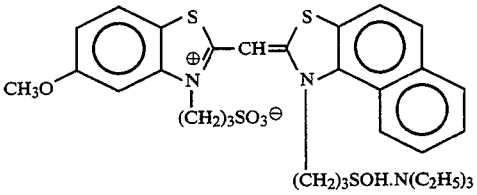
S-7
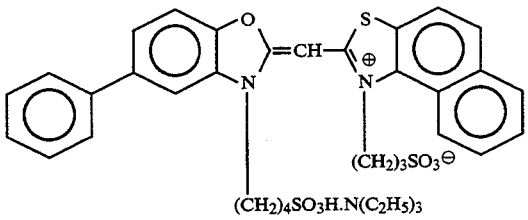
S-8
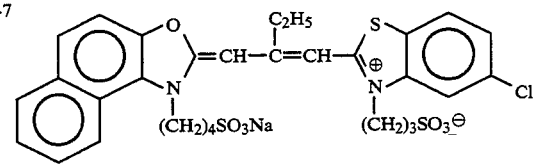
S-9
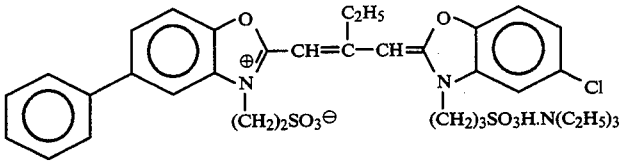

TABLE B-continued
D-1
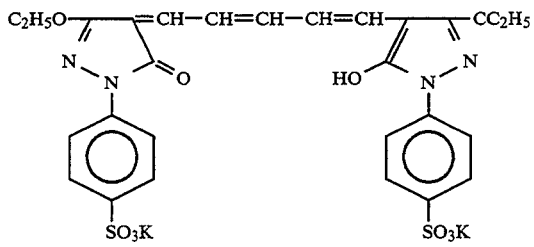
D-2
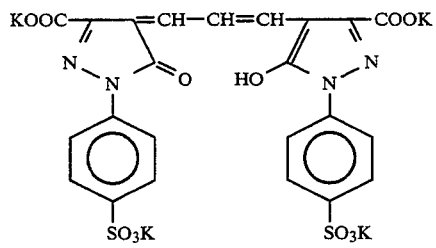
D-3
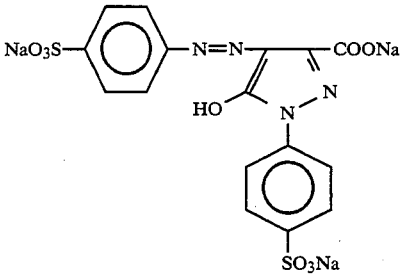
D-4
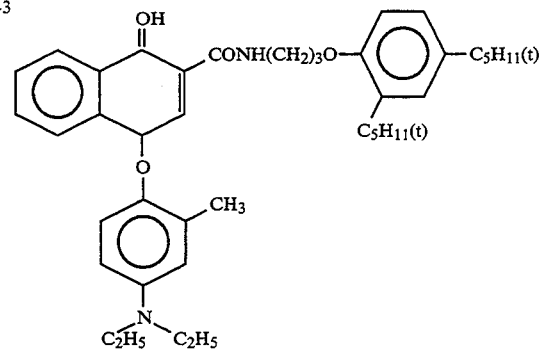
D-5
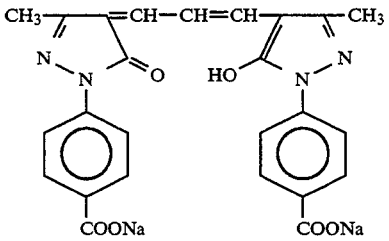
E-1
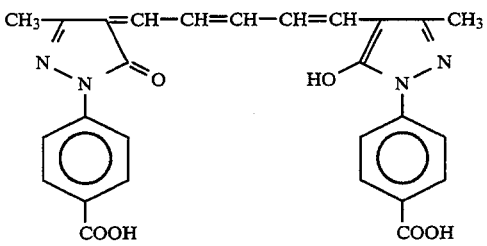
E-2
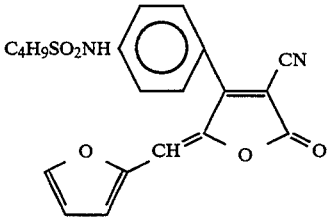
H-1
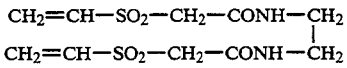
W-1
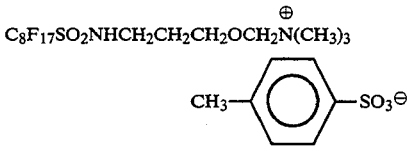
W-2
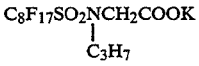
W-3
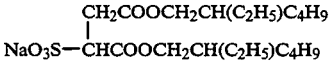
W-4
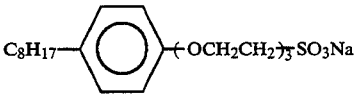
W-5
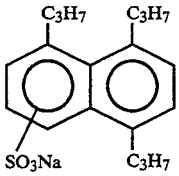
W-6
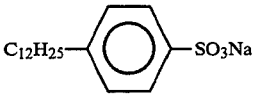

TABLE B-continued

| | | | |
|---|---|---|---|
| 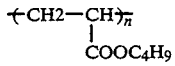 | M-1 | 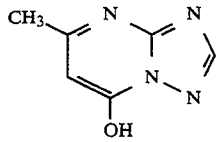 | F-1 |
| 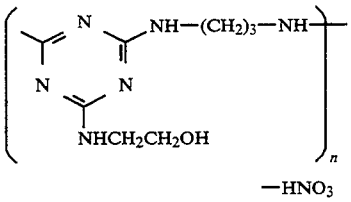 | F-2 | 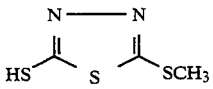 | F-3 |
| 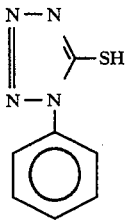 | F-4 | 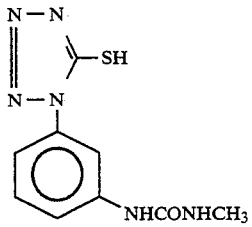 | F-5 |
| 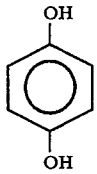 | F-6 | 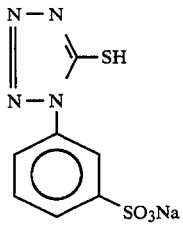 | F-7 |
| 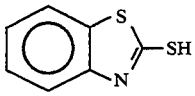 | F-8 | | |

Forming of Samples 102–119

Samples 102–119 were formed from the sample 101 by varying the type of colloidal silver added, the amount of colloidal silver, etc, as specified in Table 4.

The samples 101–119 thus obtained were exposed under an optical wedge for 1/50 second by use of a white light source having 2000 lux, and color temperature of 4800K, and subjected to the development processing described below.

Also, another processing in which the first development time is extended to 8 minutes, was performed, and changes in sensitivity with respect to the case where the first development time was 6 minutes were summarized in Table 4. The photographic sensitivity of each sample was obtained from the exposure amount required to impart a color density of 1.0 in each of color-sensitive layer.

TABLE 4

| Sample No. | Preparation method of samples (change in step from sample 101) | Difference in sensitivity between 6 min and 8 min of first developing time (ΔSI.O) Red-sensitive layer | Green-sensitive layer | Blue-sensitive layer | Change in color flavor (the lower the better) |
|---|---|---|---|---|---|
| 101 (Present Invention) | Reference sample (Maximum absorption wavelength of yellow colloidal silver was 450 nm) | 0.30 | 0.31 | 0.32 | 2 |
| 102 (Comparative example) | Removal of colloidal silver from layers 3 and 8 | 0.20 | 0.22 | 0.31 | 9 |
| 103 (Comparative example) | Removal of colloidal silver from layer 3 | 0.21 | 0.28 | 0.32 | 11 |
| 104 (Comparative example) | Removal of colloidal silver from layer 8 | 0.26 | 0.22 | 0.30 | 8 |

TABLE 4-continued

| Sample No. | Preparation method of samples (change in step from sample 101) | Difference in sensitivity between 6 min and 8 min of first developing time (ΔSI.O) Red-sensitive layer | Green-sensitive layer | Blue-sensitive layer | Change in color flavor (the lower the better) |
|---|---|---|---|---|---|
| 105 (Comparative example) emulsion) | Replacement of colloidal silver in layer 8 with 3 times as much silver amount of emulsion O (fogged | 0.25 | 0.24 | 0.32 | 8 |
| 106 (Present Invention) | Replacement of colloidal silver in layer 3 with the colloidal silver which the maximum absorption wavelength was 480 nm obtained by further addition of equivalent silver amount of KI | 0.28 | 0.29 | 0.32 | 4 |
| 107 (Comparative example) | Replacement of colloidal silver in layer 3 with the colloidal silver which the silver to 550 nm obtained by further addition of equivalent silver amount of KI | 0.23 | 0.28 | 0.31 | 8 |
| 108 (Comparative example) | Replacement of colloidal silver in layer 3 with equivalent silver amount of black colloidal silver | 0.21 | 0.27 | 0.31 | 10 |
| 109 (Comparative example) | Transfer colloidal silver in layer 8 to layer 9 (lowest-sensitivity green-sensitive layer) | 0.29 | 0.43 | 0.32 | 11 |
| 110 (Comparative example) | Transfer colloidal silver in layer 8 to layer 7 | 0.33 | 0.23 | 0.32 | 10 |
| 111 (Comparative example) | Provision of interlayer consisting only of gelatin between layers 13 and 14 | 0.29 | 0.30 | 0.32 | 8 |
| 112 (Present Invention) | Removal of colloidal silver from layer 8, and removal of interlayer of layer 12 | 0.27 | 0.33 | 0.32 | 6 |
| 113 (Present Invention) | Transfer of colloidal silver in layer 8 to layer 7, removal of layer 12, and removal of colloidal silver from layer 3 | 0.37 | 0.37 | 0.32 | 5 |
| 114 (Present Invention) | Removal of layers 5, 10, and 15 | 0.20 | 0.21 | 0.24 | 4 |
| 115 (Comparative example) | Removal of layers 5, 10, and 15, and removal of colloidal silver from layers 3 and 8 | 0.18 | 0.15 | 0.23 | 8 |
| 116 (Present Invention) | Removal of emulsion O from layers 4 and 10 | 0.26 | 0.27 | 0.31 | 5 |
| 117 (Comparative example) | Removal of emulsion O from layers 4 and 10, and colloidal silver from layers 3 and 8 | 0.20 | 0.22 | 0.30 | 10 |
| 118 (Present Invention) | Removal of Cpd-I and Cpd-J from layer 2 | 0.36 | 0.33 | 0.32 | 4 |
| 119 (Present Invention) | Removal of Cpd-I and Cpd-J from layer 2, and colloidal silver from layers 3 and 8 | 0.30 | 0,26 | 0.31 | 5 |

From the results listed in Table 4, the following conclusions were drawn.

1. Regarding the sample 101, in the case where yellow colloidal silver is not contained in layers adjacent to the layers having a color sensitivity as in the samples 102–105, the change in sensitivity of the color-sensitive layer during a push-processing decreases. Such a decrease in sensitivity creates a change in color balance, and therefore is not desirable.

2. Regarding the sample 101, when pAg of yellow colloidal silver is raised as in the samples 107 and 108, and the maximum absorption wavelength of colloidal silver is elongated, the rise of the sensitivity obtained by the push-processing is undesirably decreased. In order to obtain a preferable push-processing suitability, it is necessary that all the layers adjacent to each of the layer having a color sensitivity contains yellow colloidal silver.

3. Regarding the sample 101, in the case where yellow colloidal silver is located adjacent to the lowest-sensitivity layer of each of the layer having a color sensitivity as in the samples 109–113, the gradation change during sensitization is small.

4. The effect obtained by adding colloidal silver also in the layers adjacent to the red-sensitive and green-sensitive layers is most prominent in the case of the sample 101 with respect to the sample 102. The effect is far great in the case where each of the layer having a color sensitivity consists of two layers (sample 114 with respect to sample 115).

5. The change in color balance during the push-processing is most preferable in the sample 101, and it is preferable to contain a DIR compound or surface-fogged emulsion because an emulsion containing such a material exhibits a small change in color balance.

The processing method was performed under the following conditions.

| Process | Time | Temperature | Tank volume | Quantity of replenisher |
|---|---|---|---|---|
| First development | 6 min | 38° C. | 12 l | 2200 ml/m$^2$ |
| First washing | 2 min | 38° C. | 4 l | 7500 ml/m$^2$ |
| Reversion | 2 min | 38° C. | 4 l | 1100 ml/m$^2$ |
| Coloring development | 6 min | 38° C. | 12 l | 2000 ml/m$^2$ |
| Pre-bleaching | 2 min | 38° C. | 4 l | 1100 ml/m$^2$ |
| Bleaching | 6 min | 38° C. | 12 l | 220 ml/m$^2$ |
| Fixing | 4 min | 38° C. | 8 l | 1100 ml/m$^2$ |
| Second washing | 4 min | 38° C. | 8 l | 7500 ml/m$^2$ |
| Final Rinsing | 1 min | 25° C. | 2 l | 1100 ml/m$^2$ |

The compositions of the respective processing solutions were as follows.

| (First developing solution) | Mother solution | Replenishment solution |
|---|---|---|
| Pentasodium nitrilo-N,N,N-trimethylene phosphate | 1.5 g | 1.5 g |
| Pentasodium diethylene-triaminepentaacetate | 2.0 g | 2.0 g |
| Sodium sulfite | 30 g | 30 g |
| Hydroquinone potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 ml | 1000 ml |
| pH | 9.60 | 9.60 |

The pH value was adjusted by use of sulfuric acid or potassium hydroxide.

| (Reversing solution) | Mother solution | Replenishment solution |
|---|---|---|
| Pentasodium nitrilo-N,N,N-trimethylene phosphate | 3.0 g | same as Mother solution |
| Stannous chloride dihydrate | 1.0 g | same as Mother solution |
| p-aminophenol | 0.1 g | same as Mother solution |
| Sodium hydroxide | 8 g | same as Mother solution |
| Glacial acetic acid | 15 ml | same as Mother solution |
| Water to make | 1000 ml | same as Mother solution |
| pH | 6.0 | same as Mother solution |

The pH value was adjusted by acetic acid or sodium hydroxide.

| (Color developing solution) | Mother solution | Replenishment solution |
|---|---|---|
| Pentasodium nitrilo-N,N,N-trimethylene phosphate | 2.0 g | 2.0 g |

-continued

| (Color developing solution) | Mother solution | Replenishment solution |
|---|---|---|
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methane-sulfonamidoethyl)-3-methyl-4-aminoaniline 3/2 sulfate monohydrate | 11 g | 11 g |
| 3,6-dithiaoctane-1,8-diol | 1.0 g | 1.0 g |
| water to make | 1000 ml | 1000 ml |
| pH | 11.80 | 12.00 |

The pH value was adjusted by sulfuric acid or potassium hydroxide.

| (Prebleaching solution) | Mother solution | Replenishment solution |
|---|---|---|
| Disodium ethylenediamine tetraacetate dihydrate | 8.0 g | 8.0 g |
| Sodium sulfite | 6.0 g | 8.0 g |
| 1-thioglycerol | 0.4 g | 0.4 g |
| Formaldehyde sodium hisulfite additive | 30 g | 35 g |
| Water to make | 1000 ml | 1000 ml |
| pH | 6.30 | 6.10 |

The pH value was adjusted by use of acetic acid or sodium hydroxide.

| (Bleaching solution) | Mother solution | Replenishment solution |
|---|---|---|
| Disodium ethylenediamine tetraacetate dihydrate | 2.0 g | 4.0 g |
| Ferric ammonium ethylenediamine tetraacetate dihydrate | 120 g | 240 g |
| Potassium bromide | 100 g | 200 g |
| Ammonium nitrate | 10 g | 20 g |
| Water to make | 1000 ml | 1000 ml |
| pH | 5.70 | 5.50 |

The pH value was adjusted by use of nitric acid or sodium hydroxide.

| (Fixing solution) | Mother solution | Replenishment solution |
|---|---|---|
| Ammonium thiosulfate | 80 g | same as Mother solution |
| Sodium sulfite | 5.0 g | same as Mother solution |
| Sodium bisulfite | 5.0 g | same as Mother solution |
| Water to make | 1000 ml | same as Mother solution |
| pH | 6.60 | same as Mother solution |

The pH value was adjusted by use of acetic acid or ammonium water.

| | (Stabilizing solution) | |
|---|---|---|
| | Mother solution | Replenishment solution |
| 1,2-benzoisothializon-3-one | 0.02 g | 0.03 g |
| Polyoxyethylene-p-mononononylphenylether (average polymerization degree: 10) | 0.3 g | 0.3 g |
| Polymaleinic acid (average molecular weight: 2000) | 0.1 g | 0.15 g |
| Water to make | 1000 ml | 1000 ml |
| pH | 7.0 | 7.0 |

What is claimed is:

1. A silver halide color photographic light-sensitive material being capable of forming a color reversal image and comprising a support having provided thereon at least one blue-sensitive emulsion layer, at least one green-sensitive emulsion layer, and at least one red-sensitive emulsion layer, wherein each blue-sensitive emulsion layer, each green-sensitive emulsion layer, and each red-sensitive emulsion layer consists of at least three layers having different sensitivities from each other, wherein adjacent to at least one blue-sensitive emulsion layer is a layer containing yellow colloidal silver, adjacent to at least one green-sensitive emulsion layer is a layer containing yellow colloidal silver, and adjacent to at least one red-sensitive emulsion layer is a layer containing yellow colloidal silver, and wherein yellow colloidal silver is not present in the blue-sensitive emulsion layer, the green-sensitive emulsion layer, and the red-sensitive emulsion layer, and said light-sensitive material further comprises a DIR compound represented by the following formula Formula $$A-(L)_n-(G)_m-(Time)_t-X$$

wherein A represents a redox mother nucleus or a precursor thereof, and a group which enables $-(Time)_t-X$ to leave when the compound is oxidized during the processing of photograph development, and X represents a development inhibitor: L represents a divalent linking group, and G represents an acidic group; Time represents a group which can further release X thereafter, and may have a time-adjusting function, or may be a coupler which releases X when reacted with an oxidized form of a developing agent, or may be a redox group; and n, m, and t are 0 or 1; provided that when $n=1$, m cannot be 0.

2. The silver halide color photographic light-sensitive material according to claim 1, wherein the yellow-colloidal-silver-containing layers are located adjacent to the lowest-sensitivity layer of each of layer having a color sensitivity.

3. The silver halide color photographic light-sensitive material according to claim 1, wherein the total amount of silver coated is 2 $g/m^2$ or more.

4. The silver halide color photographic light-sensitive material according to claim 1, containing surface-fogged and/or internal-fogged silver bromoiodide emulsion.

* * * * *